United States Patent [19]

Falk et al.

[11] Patent Number: 4,927,051

[45] Date of Patent: May 22, 1990

[54] MULTIPLE-PRODUCT MERCHANDISING MACHINE

[75] Inventors: Leonard P. Falk, Florissant; Paul K. Griner, St. Louis County, both of Mo.

[73] Assignee: UniDynamics Corporation, New York, N.Y.

[21] Appl. No.: 112,475

[22] Filed: Oct. 26, 1987

[51] Int. Cl.[5] ..... G07F 11/54

[52] U.S. Cl. ..... 221/12; 221/4; 221/5; 221/21; 221/76; 221/91; 221/120; 221/122; 221/129; 221/152; 221/153; 221/155; 221/242; 194/350

[58] Field of Search ..... 221/4, 5, 12, 13, 21, 221/76, 91, 92, 119, 120, 121, 122, 129, 151, 152, 153, 154, 155, 241, 242; 194/350; 312/97, 97.1, 125, 135, 305, 138 R; 364/479

[56] References Cited

U.S. PATENT DOCUMENTS

| | | | |
|---|---|---|---|
| 1,416,566 | 5/1922 | McCleary . | |
| 1,717,943 | 6/1929 | Smith . | |
| 2,016,127 | 10/1935 | Weiler . | |
| 2,104,497 | 1/1938 | Schulte . | |
| 3,096,907 | 7/1963 | Bouracier . | |
| 3,102,761 | 9/1963 | Andrews et al. . | |
| 3,102,762 | 9/1963 | Johnson et al. . | |
| 3,107,815 | 10/1963 | Wittenborg . | |
| 3,122,401 | 2/1964 | Johnson | 221/120 X |
| 3,129,039 | 4/1964 | Staley . | |
| 3,135,567 | 6/1964 | Braunsberg | 312/97.1 |
| 3,190,706 | 6/1965 | Hatcher et al. . | |
| 3,390,754 | 7/1968 | Newberry . | |
| 3,556,284 | 1/1971 | Dyer et al. . | |
| 3,710,482 | 1/1973 | Grafford . | |
| 3,940,016 | 2/1976 | Krakauer | 221/129 |
| 4,049,154 | 9/1977 | Burks | 221/76 |
| 4,049,330 | 9/1977 | Schlapp | 312/97.1 X |
| 4,118,082 | 10/1978 | Hoop | 312/97.1 X |
| 4,192,436 | 3/1980 | Schuller et al. | 221/129 |
| 4,223,210 | 9/1980 | Verduin . | |
| 4,284,184 | 8/1981 | Hoffman | 221/129 X |
| 4,317,604 | 3/1982 | Krakauer | 312/97.1 |
| 4,391,388 | 7/1983 | Krakauer | 221/76 |
| 4,498,603 | 2/1985 | Wittenborg | 221/76 |
| 4,677,777 | 7/1987 | Hoffman et al. . | |
| 4,722,058 | 1/1988 | Nakayama et al. | 221/12 X |

FOREIGN PATENT DOCUMENTS

| | | | |
|---|---|---|---|
| 761481 | 11/1956 | United Kingdom | 312/97.1 |

OTHER PUBLICATIONS

Roboserve sales brochure, London, England, circa Jan. 1980.

*Primary Examiner*—Michael S. Huppert
*Assistant Examiner*—David H. Bollinger
*Attorney, Agent, or Firm*—Senniger, Powers, Leavitt and Roedel

[57] ABSTRACT

A multiple-product merchandising machine having a cylindrical drum mounted within a cabinet. The drum is divided into a plurality of horizontal shelves each of which is divided by a plurality of vertical walls into separate compartments from which the product can be dispensed. These compartments can be brought into alignment with access doors associated with each level and the doors, which are normally maintained locked, can be opened upon the insertion of adequate currency in the machine to remove the product. The access door locking system prevents more than one door from being opened at one time. The drum is rotatable in either direction by a reversible motor. A viewing area is provided in the front of the machine which allows a prospective customer to see the product as it passes by. The drum is divided into sections with opaque walls which prevent viewing from the viewing area of more than half of the compartments on a shelf when the drum is in its rest position. The drum can be restricted in its rotation so that less than all of the compartments can be accessed by the access doors. The section which is accessable can be changed at different times of day, or if the previous section has had a lot of its items sold so that a new supply of items can be viewed and accessed.

19 Claims, 22 Drawing Sheets

MULTIPLE-PRODUCT MERCHANDISING MACHINE

BACKGROUND OF THE INVENTION

The present invention relates to multiple-product merchandising machines and more particularly to such machines which dispense many different kinds and sizes of products from a cylindrical drum mounted within a cabinet and configured to dispense the desired product to a customer upon the insertion in the machine of adequate currency.

Some existing multiple-product merchandising machines of the type to which the present invention relates are generally configured to show to a potential customer as much of the available product as possible without rotation of the drum. This is accomplished in some cases by utilizing transparent shelves and/or walls to separate the shelves into compartments which hold individual products so that only a single product is accessible to a customer at one time. The products are accessible through access doors which are generally locked until adequate currency is inserted to allow the customer to open a door and access only the compartment adjacent it. Generally, the access doors are transparent to allow viewing of the product on the shelves and also an additional viewing area is sometimes provided to enlarge the total number of products that can be seen at one time.

Because of this design approach many other desirable features in such a machine are precluded. For example, it might not be desirable to show as many of the product compartments as possible since the person servicing or tending the machine may wish to leave some compartments empty or at least not visible at certain times. Also, in certain circumstances it is desirable to limit access to only some of the compartments while not others.

It is also a common feature in existing machines to have a common price for all product compartments on a shelf. However, this limits the versatility of the machine since it requires selection by the servicing personnel of items of comparable price or the offering of only a single type of item in all of the compartments on a shelf.

Also, existing drum type machines rotate the drum in only one direction so that if a customer misses a selection he must rotate the drum through a complete revolution before he has access to the compartment again. This is time consuming and impractical for some uses to which the present invention can be applied.

It is also a disadvantage of existing machines that they do not keep track of what compartments products have been sold from or, at least, what compartments have been accessed. This ability has several advantages, discussed in detail below in connection with the present invention, such as determining if a compartment has already been accessed once and thus preventing a second access to the same compartment. This has the dual advantages of preventing a customer from inadvertently accessing an empty compartment from which the product has already been dispensed, or preventing access to a product in a compartment which has been accessed, tampered with and returned to its compartment.

SUMMARY OF THE INVENTION

The present invention overcomes the above-described difficulties and disadvantages associated with prior art devices and provides further additional features not available in such designs.

This is accomplished by the provision of a multiple-product merchandising machine of the drum type which has a plurality of annular shelves arranged around and fixed to a center column for rotation therewith and which shelves are divided into a plurality of compartments by walls, at least some of which are opaque and so arranged around the drum that when the drum is in a rest position less than half of the compartments are visible to a potential customer through the viewing area provided in the cabinet in which the drum is housed. Rotation of the drum in either direction is controlled by a microprocessor so as to rotate the drum into a predetermined rest position by the shortest path of rotation shortly after a customer has made a selection.

Sensors provide information to the microprocessor with respect to the position of the access doors and the position of the drum in its rotation so that access to each compartment on the drum can be monitored, inventoried and controlled. Also, restriction to certain areas of the drum, such as one-third or two-thirds of its circumference, can be programmed into the microprocessor. Such access can also be controlled from a time standpoint to allow access to that portion of the drum previously restricted, such as during the second shift at a factory to supply a previously unavailable selection of items.

Also, the price of selected items in the drum can be discounted at selected times of day. For example, a section of the shelves with perishable items can be discounted by 50% late in the day to reduce the inventory of items that might later have to be discarded. In fact, provision is made for multiple discounts so that, for example, one section of one shelf can be set for one of two discounts that are programmed into the machine, such as 25% and 50%, and another section of the same shelf can have another discount selected from its programmed two discounts. Thus, different compartments can be subjected to different discounts and the prices of the items, discounted or not, will be shown adjacent the access door as the compartment becomes aligned with it.

Advantages of the present invention are further accomplished by the provision of a multiple-product merchandising machine, comprising: a cabinet; a cylindrical merchandise carrying drum mounted within the cabinet for rotation about its central longitudinal axis and having a plurality of annular product supporting shelves at spaced intervals along the drum concentric with the axis of the drum, a plurality of walls extending between adjacent shelves and together with the shelves defining a plurality of individual compartments in which product may be placed; a plurality of access doors in the cabinet, one each associated with a respective shelf on the merchandise carrying drum and disposed adjacent thereto for allowing access to a compartment on the respective shelf when the compartment is aligned with it, the access doors being movable between an open position and a closed position and being normally locked in the closed position; currency actuated means for allowing a selected access door to be moved from the closed position to the open position when a predetermined amount of currency is inserted by a customer; reversible motor means for rotating the merchandise carrying drum in either direction; manually controllable actuating means for actuating the reversible motor means to rotate the merchandise carrying drum to allow a customer to bring any compartment on a shelf into alignment with the associated access door; and control means for activating the motor means at a predetermined time after a selection has been made and in either direction of rotation with the least amount of rotation of the drum to bring the drum to a predetermined rest position.

These advantages over the prior art are further accomplished by the provision of a multiple-product merchandising machine having a cabinet, a cylindrical merchandising drum disposed for rotation within the cabinet and having a plurality of annular shelves arranged around the drum at spaced intervals along the axis of the drum and a plurality of walls parallel to the axis of the drum dividing the shelves into separate product carrying compartments, a plurality of normally closed and locked access doors in the cabinet one each disposed adjacent a respective shelf for allowing a customer to remove product from a compartment aligned with one of the doors, the doors being transparent and forming at least part of a viewing area in the cabinet which allows a potential customer to view several of the compartments on a shelf at one time without rotating the drum, means for accepting currency from a customer, and means allowing opening of one of the doors for dispensing a product from a compartment if the currency accepted is at least equal to the price set for the product in that compartment, and means for setting prices for different compartments on each of the shelves.

Further advantages of the present invention are obtained by a multiple-product merchandising machine including a cabinet, a cylindrical merchandise carrying drum mounted within the cabinet for rotation about its longitudinal axis, a central column extending the length of the drum and having a plurality of circular shelves mounted to the column at spaced intervals along the column, a plurality of walls parallel to the axis of the drum and dividing each shelf into a plurality of compartments, the column having a plurality of holes defined therein in communication with each of the compartments, means for forcing air through the column to exit through the holes and means along the sides of the cabinet parallel to the axis of the cabinet for receiving the air passing through the holes in the column and returning it to the means for forcing the air through the column, the means for returning the air including elongated ducts along each side of the cabinet extending for substantially the length of the drum.

Yet further advantages of the present invention are obtained by a multiple-product merchandising machine, comprising: a cabinet; a cylindrical merchandise carrying drum mounted within the cabinet for rotation about its central longitudinal axis and having a plurality of annular product supporting shelves at spaced intervals along the drum concentric with the axis of the drum, a plurality of walls extending between adjacent shelves and together with the shelves defining a plurality of individual compartments in which product may be placed; a plurality of access doors in the cabinet, one each associated with a respective shelf on the merchandise carrying drum and disposed adjacent thereto for allowing access to a compartment on the respective shelf when the compartment is aligned with it, the access doors being movable between an open position and a closed position and being normally locked in the closed position; a viewing area in the cabinet in which the products in several of the compartments on each shelf can be seen at one time by a potential customer; currency actuated means for allowing a selected access door to be moved from the closed position to the open position when a predetermined amount of currency is inserted by a customer; reversible motor means for rotating the merchandise carrying drum in either direction; manually controllable actuating means for actuating the reversible motor means to rotate the merchandise carrying drum to allow a customer to bring any compartment on a shelf into alignment with the associated access door; and control means for activating the motor means at a predetermined time after a selection has been made, to bring the drum to a predetermined rest position wherein a predetermined portion of the compartments on the drum are not visible through the viewing area.

Yet another advantage of the present invention is attained by a multiple-product merchandising machine having a cabinet, a cylindrical merchandising drum disposed for rotation about a vertical axis within the cabinet and having a plurality of annular horizontally disposed shelves arranged around the drum at spaced intervals along the axis of the drum and a plurality of walls parallel to the axis of the drum dividing the shelves into separate product carrying compartments, a plurality of normally closed and locked access doors aligned in a common vertical plane on a wall of the cabinet, one each disposed adjacent a respective shelf for allowing a customer to remove product from a compartment aligned with one of the doors, means for accepting currency from a customer, and means allowing opening of one of the doors for dispensing a product from a compartment if the currency accepted is at least equal to the price set for the product in that compartment, the means for allowing opening of the doors including: a locking strip extending along adjacent edge portions on one side of the doors and supported on the cabinet for limited vertical movement adjacent the doors, lifting means associated with each of the doors for engaging the locking strip when each door is moved from the closed position and for lifting the locking strip to a first position, first sensor means engaging the locking strip to determine if the strip is in the first position, a plurality of second sensor means one each associated with a respective lifting means for sensing if its associated door has been moved from the closed position, locking means movable between a locking position in which it engages the strip to prevent its movement past the first position thereof, and a further position which allows the lifting means to move the strip to a second position which allows a door to be opened to permit access to a compartment, means associated with the first and second sensor means for determining if the first sensor means has sensed movement of the strip to the first position and for determining if one or more of the doors have been moved from the closed position and for actuating the locking means to move from the locking position to the further position only when the first sensor means is sensed to have been actuated and only if only one of the second sensor means has been actuated.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
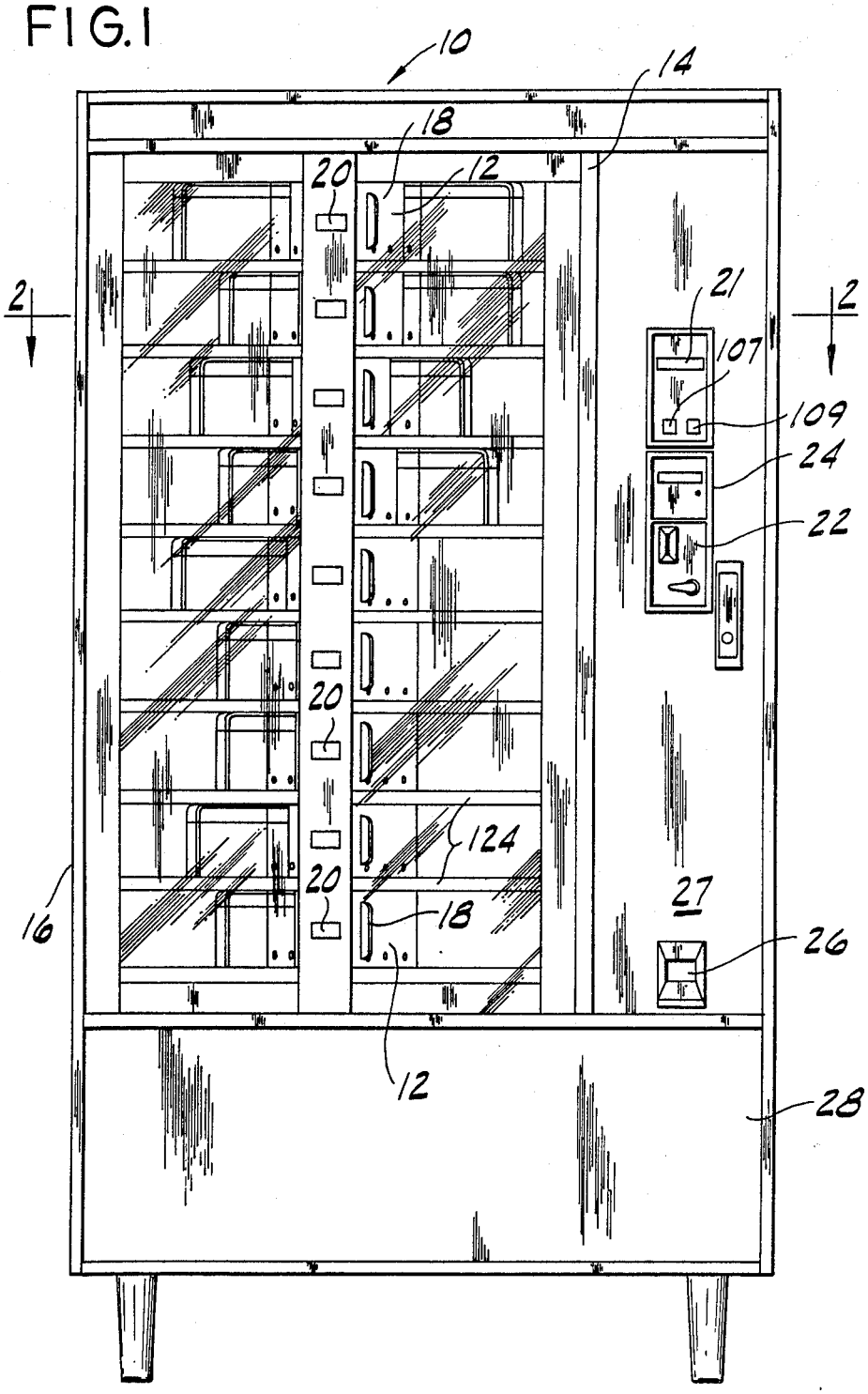
FIG. 1 is a front view of the preferred embodiment of the multiple-product merchandising machine of the present invention.

In the preferred embodiment of the multiple-product merchandising machine 10 of the present invention, as best seen in FIG. 1, a plurality of transparent access doors 12 are mounted in the front service door 14 which forms most of the front of the cabinet 16 of the machine. The access doors 12 are in a common vertical plane and are slidably mounted within the service door 14 for horizontal sliding movement between a closed, normally locked position, as they are shown in FIG. 1, and an open position which permits access to the interior of the cabinet 16. A handle 18, also transparent, is mounted to or formed in each access door 12 to permit the doors to be manually moved between the open and closed positions. Adjacent each door 12 is a price display 20 which indicates the price of the product which can be purchased and removed from the adjacent door. The price displays are electronic, such as LED, LCD or similar electronic form so they can be easily changed from a control panel disposed at a remote location as is discussed in more detail below. A similar electronic display 21 for credit and other messages is mounted on the service door 14.

Figure 2:
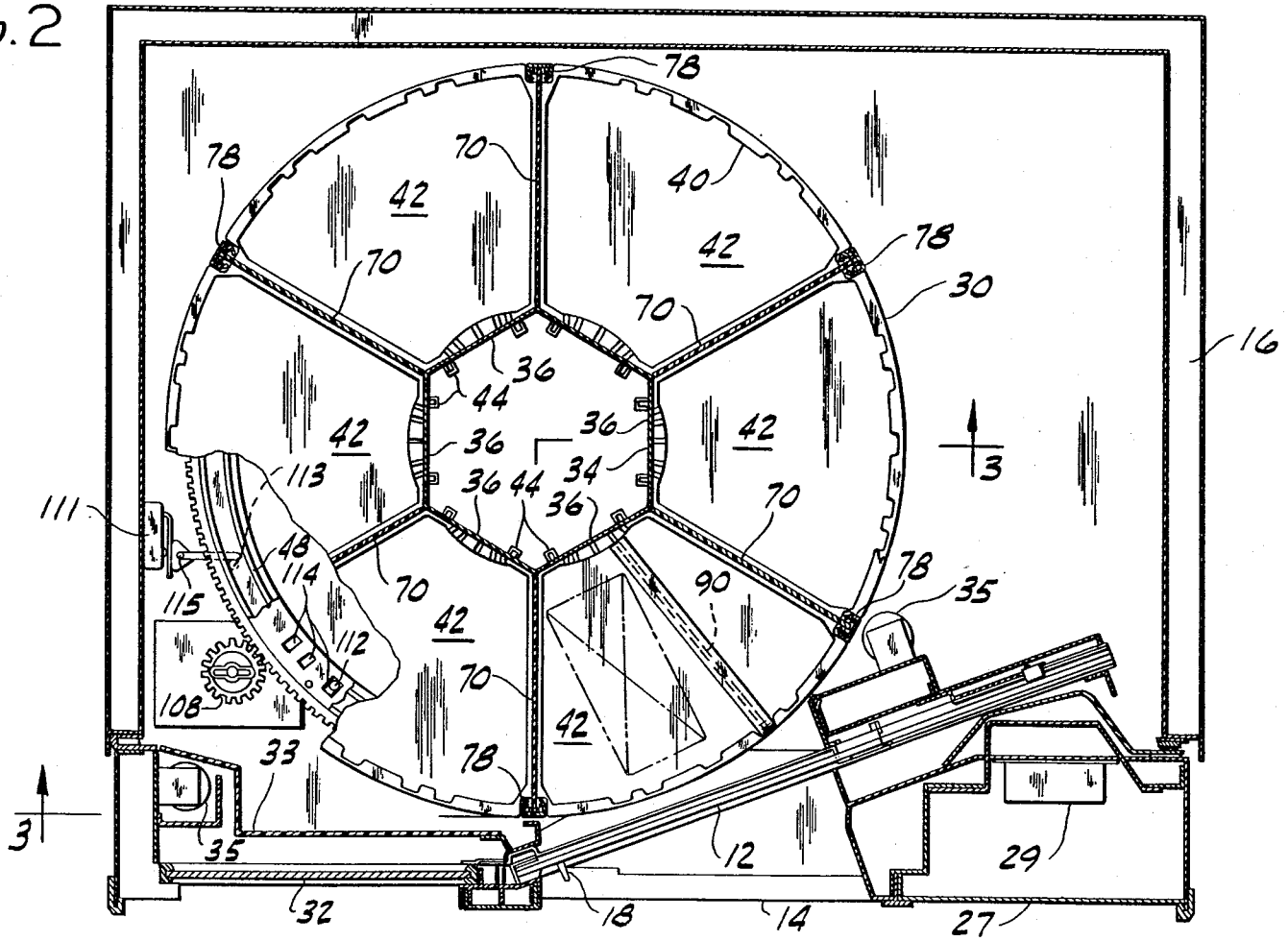
FIG. 2 is a top sectional view along the line 2—2 of FIG. 1.

Also mounted in the service door 14 are coin and bill receiving and validating mechanisms 22 and 24, respectively, and a coin return receptacle 26, all of a form well known in the art. The service door 14 is hinged on the left of the cabinet 16 as viewed in FIG. 2. A monetary door 27 is mounted within and forms part of the service door 14 and is also hinged on its left edge. The monetary door 27 covers the coin mechanism 22 and bill validator 24 which are contained within the space in the service door behind the monetary door 27 as seen in FIG. 2. Also contained in this area behind the monetary door is the control panel 29 used to set various functions of the machine including prices and discounts as discussed in more detail below. A front skirt 28 forms the lower part of the service door 14 and covers an area of the cabinet beneath the access doors 12 which houses refrigeration equipment, etc.

As best seen in FIG. 2, mounted within the cabinet 16 for rotation is a cylindrical merchandise carrying drum 30 disposed behind the access doors 12 and a glass plate 32 forming an additional product viewing area behind which is a transparent plastic air deflection and insulation sheet 33. Fluorescent lights 35 are disposed on the service door 14 on each side of the viewing area to assist a customer in viewing the products.

The drum 30 is composed of a hexagonal sheet metal center column 34 which extends the full height of the drum. Each panel 36 which forms a side of the drum 30 has two rectangular holes 38 formed therein at the level of each of the annular shelves 40. Each shelf 40 is composed of six identical transparent plastic trays 42, each of which has tabs 44 which are received in the respective holes 38 and rest on the lower edge thereof to position the trays around the column 34. Bolted or otherwise secured to the top of the column is a sheet metal top disk (not shown) with a diameter approximately the same as the diameter of the annular shelves 40.

The bottom of the column 34 is fastened to a sheet metal base disk 46, approximately the diameter of the annular shelves 40, which in turn has bolted thereto a plastic ring gear 48 with a diameter also approximately the diameter of the shelves 40. A sheet metal ring 50 with an L-shaped cross section is fastened to the bottom of disk 46 and has a diameter less than the diameter of the ring gear 48. The ring 50 supports a plurality of rollers 52 on pins 54 mounted on the ring 50. The rollers 52 ride on the upper surface of a sheet metal floor plate 56 which forms a floor to the merchandise containing area of the machine 10, to support the drum 30 for rotation.

Figure 3:
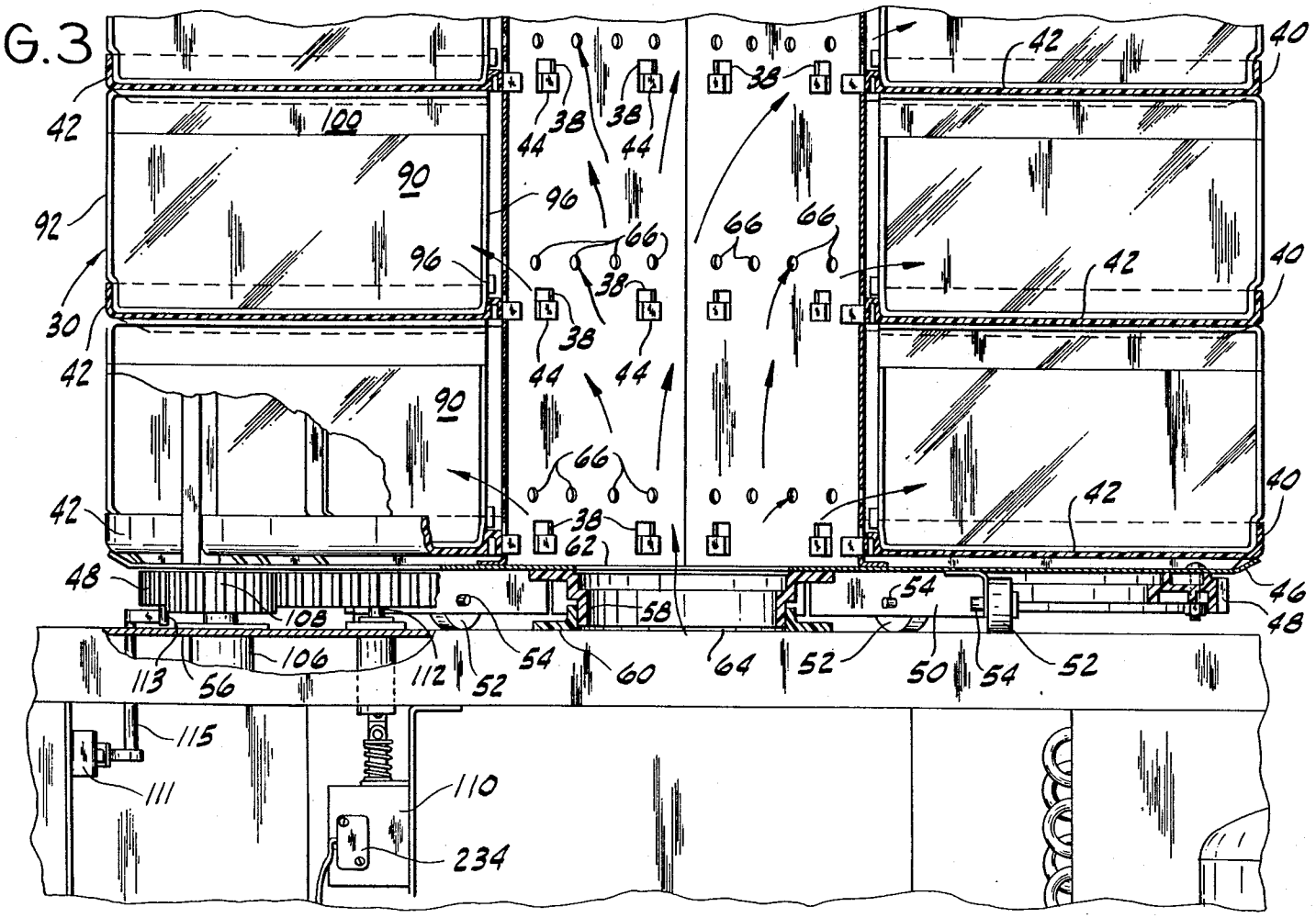
FIG. 3 is an enlarged partial sectional view along the line 3—3 of FIG. 2.

An annular plastic sleeve 58 is secured to the lower surface of base disk 46 and is matingly received in annular sleeve 60 secured to the floor plate 56. Both the base disk 46 and floor plate 56 have corresponding circular holes 62 and 64, respectively, which together with the sleeves 58 and 60 allow air to flow from the lower portion of the cabinet into the center column 34. Air handling and refrigeration equipment (not shown) contained in the lower portion of the cabinet is used to force cold air in the center column 34 through the sleeves 58 and 60 where it is then distributed uniformly over the products on the shelves 40 by passing through the plurality of holes 66 formed in each of the panels 36, as shown by the arrows in FIG. 3.

Also forming part of the merchandise carrying drum 30 are a plurality of walls 70, which in the preferred embodiment number six. Each of these walls 70 extend for the full height of the drum and are secured at their upper and lower ends to the top disk and base disk 46, respectively, of the drum 30 for rotation therewith. The walls 70 are preferably plastic and adjacent ones are alternately transparent and opaque for reasons discussed in detail below. Trays 42 extend between adjacent walls 70 to form with the walls a plurality of compartments around each shelf 40.

Figure 5:
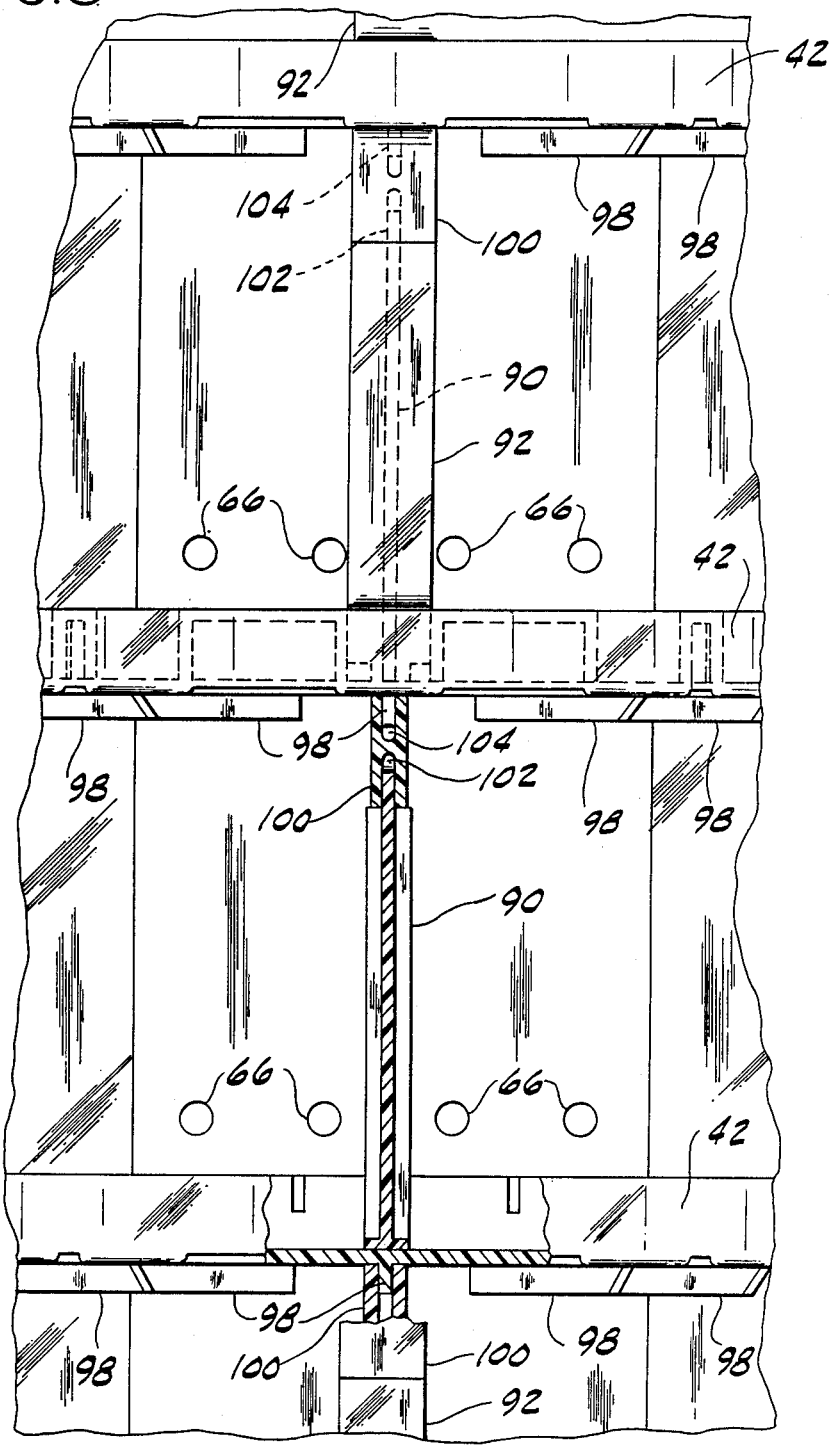
FIG. 5 is an enlarged partial front view of two shelves of the drum of the preferred embodiment.
Figure 5A:
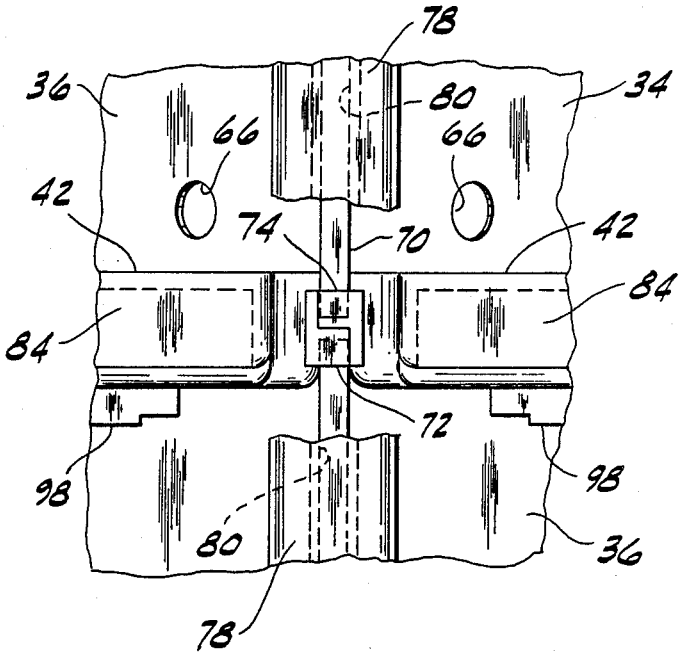
FIG. 5A is a view similar to FIG. 5 with a portion of the locking strip cut away to show the tabs on the sides of the trays.

The trays 42 each have tabs 72 and 74 on opposite outer edges of each as shown in FIG. 5 and FIG. 5A. Tab 72 is formed on the lower edge of the tray while tab 74 is formed on the upper opposite edge of the tray so that two adjacent trays can have their tabs nest with one another when they are positioned in the drum 30. The lower tab 72 of each tray 42 rests on the bottom surface of a rectangular notch 76 cut in the walls 70 at the proper places for locating the trays 42 to form the shelves 40. Once all of the trays are positioned in the notches 76 between adjacent walls 70 a channel-shaped vertical locking strip 78, preferably formed of a metal extrusion, is fixed at the ends of the adjacent walls 70 to prevent the tabs 72 and 74 from being removed from the notches 76 and thus locking the trays 42 in place. Formed as part of the strip 78 is a groove 80 which receives the edge of the wall 70 and helps rigidify it. The strip is preferably bolted at its upper and lower ends to the top disk and bottom disk of the drum 30.

Each of the trays 42 is generally dish-shaped with short side walls and can be further subdivided into smaller compartments. In each tray 42 there are provided a series of vertical channels 82 formed in the outer vertical edge wall 84 and facing the center column 34. In the preferred embodiment there are preferably five such channels which allow the tray to be divided in half, in thirds or in quarters. On the inner wall 86 of each tray are formed a series of grooves 88 which are aligned with the channels 82. Partitioning walls 90 are formed to be received in the channels 82 and grooves 88 to divide the trays as desired. The outer vertical edge 92 of each partitioning wall 90 is a wide flange which is matingly received in the channels 82. The inner vertical edge 94 of each partitioning wall 90 has a tab 96 extending from the lower portion thereof which is received in the notches 88.

Figure 4:
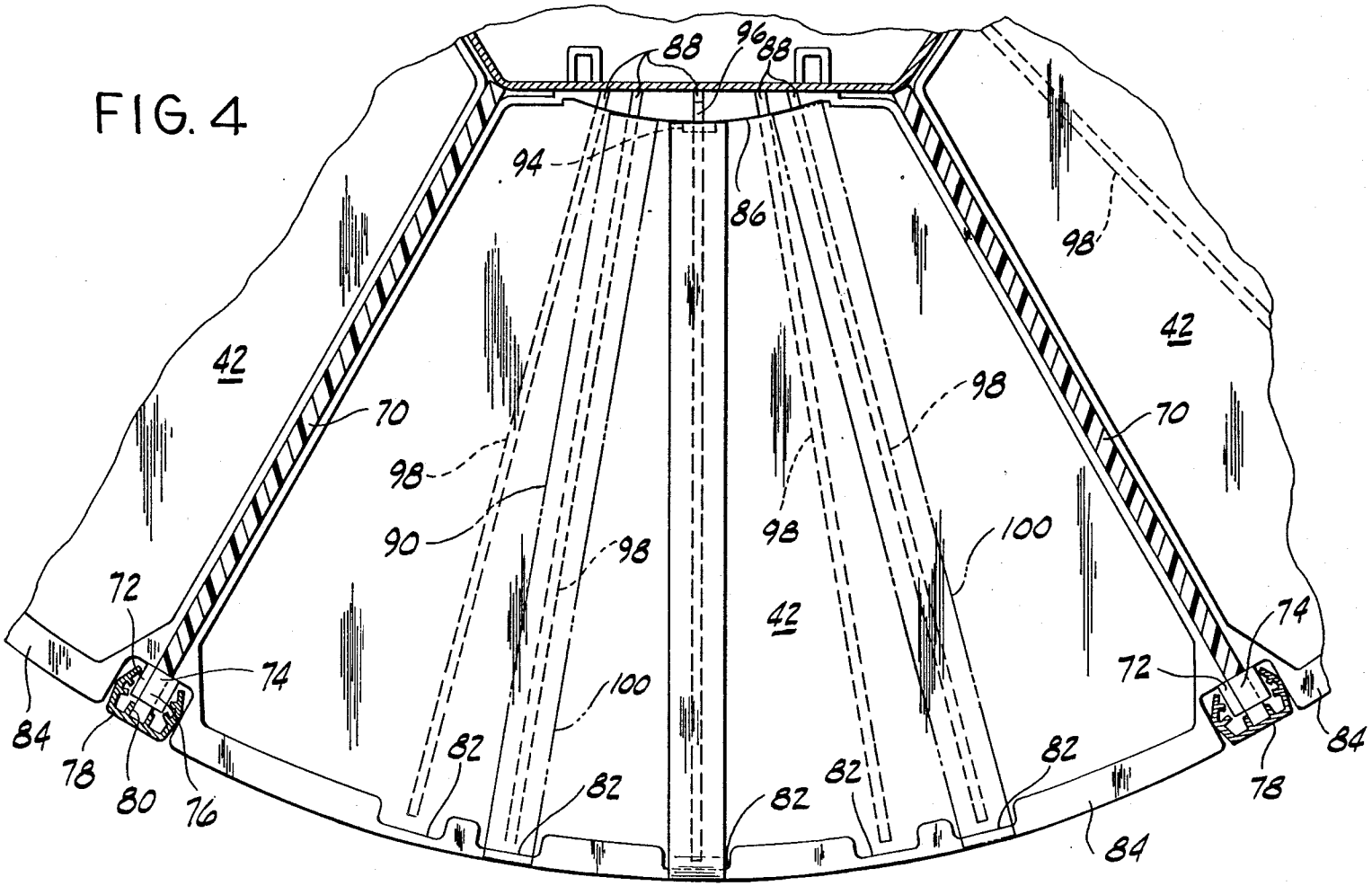
FIG. 4 is an enlarged partial sectional plan view of a portion of a shelf.

In order to rigidify the partitions 90 they are designed to engage the bottom of the tray above them. To achieve this in the preferred embodiment the bottom of each tray 42 is provided with a long tab 98 (FIG. 4) in alignment with the channels 82 and grooves 88 in each tray. A connecting piece 100 (FIG. 5) is provided which has a deep groove 102 along its lower edge for receiving the upper edge of a partition 90 and has a shallower groove 104 in its upper edge for receiving the long tab 98 in the lower surface of a tray. To assemble a partition between a top and bottom tray, the partition is first placed in the bottom tray with its outer edge 92 in a desired channel 82 and its tab 96 in a corresponding grooves 88 so that the lower edge of the partition abuts the upper surface of the bottom tray. The connecting piece is then slid onto the top edge of the partition and simultaneously along the long tab 98 until it is abutting the center column 34. This locks the partition rigidly in place. This assembly procedure is repeated for as many of the partitions as is desired. The partitions 90 are preferably all made of transparent plastic to allow a customer to see more product than is in a single compartment.

The drum 30 is rotated by a reversible electric motor 106 (FIG. 3) whose operation is controlled by a microprocessor with special programming described below. The motor 106 has a gear 108 secured to its output shaft which is drivingly engaged with the ring gear 48 secured to the bottom of the drum 30. Rotation of the motor 106 in either direction to allow a customer to review product in various areas of the drum 30 is controlled by two buttons 107 and 109 on the front of the cabinet 16 (FIG. 1). This allows a customer to rotate the drum 30 either left or right by pushing the appropriate button 107 or 109. The microprocessor keeps track of the rotational position of the drum 30 through input from the motor 106 and a microswitch 111. Switch 111 is activated when a home position pin 113, secured to the bottom of ring gear 48, engages the arm of a bidirectional rotating thermal break actuator 115 mounted for rotation in the cabinet floor. The actuator 115 has a camming surface on its lower end which engages the microswitch 111 and activates it when the pin 113 engages the arm of the actuator and moves it as the drum rotates in either direction. The actuator is biased by a spring (not shown) to a home position where it will be engaged by the pin 113 the next time it passes.

In order to accurately stop the turning of the drum 30 so that a selected compartment is located directly in front of the appropriate access door 12, a spring loaded solenoid 110 is used. When the motor 106 is to be activated the solenoid 110 is first activated to remove its plunger 112 from one of a series of corresponding holes 114 formed in the underside of the ring gear 48. There is a hole 114 corresponding to each possible partition 90 and wall 70 location in the drum 30 so that each compartment can be exactly registered with an appropriate access door 12. Thus, for the preferred embodiment there will be thirty six holes 114. Further operation of this control system is discussed below in connection with the description of the electronic circuitry.

Figure 7:
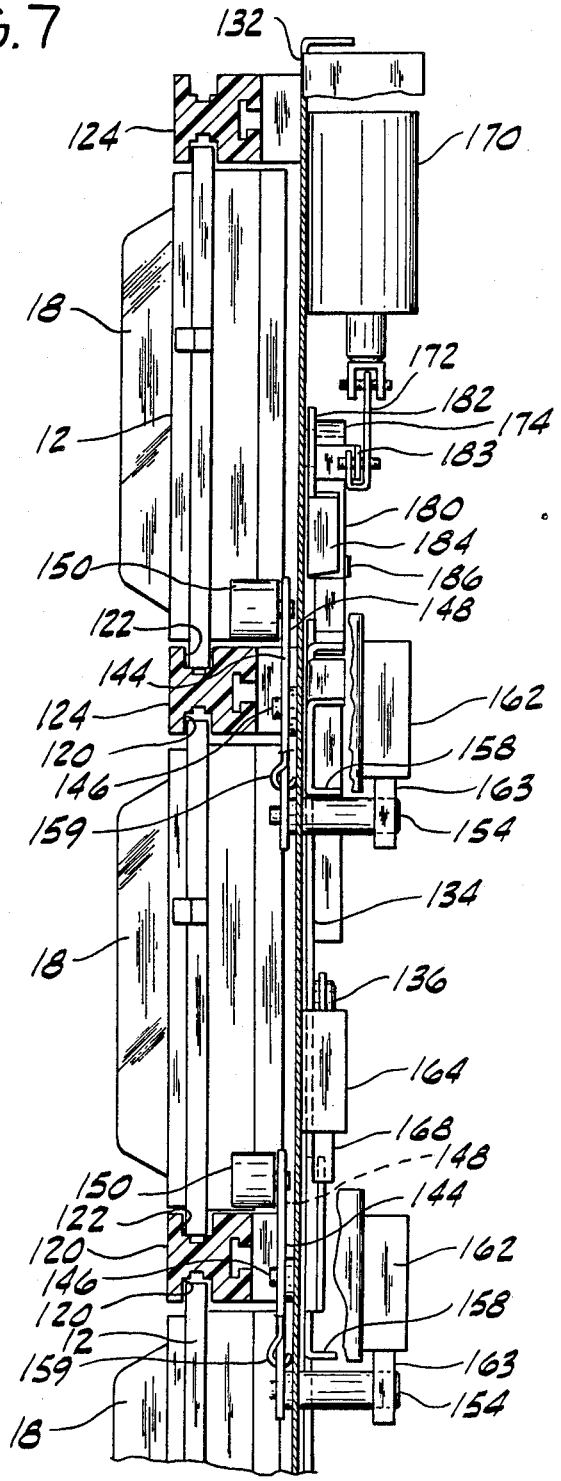
FIG. 7 is a partial sectional side view with portions cut away of the locking mechanism for the access doors, looking from the left of FIG. 6.

Referring again to the compartment access doors 12, as previously mentioned they are all in vertical alignment but are offset at an angle from the plane of the service door 14 and are generally tangent to the drum 30 for ease of access to compartments which are aligned with them (FIG. 2). As seen in FIG. 7, each access door 12 is positioned with its top and bottom edges in respective channels 120 and 122 which are formed in a horizontal bar 124 secured to the front face of the service door 14. The doors 12 can be slid in these channels 120 and 122 between their closed position, where they are normally locked, and their open position where they permit access to a compartment aligned with them.

Figure 6:
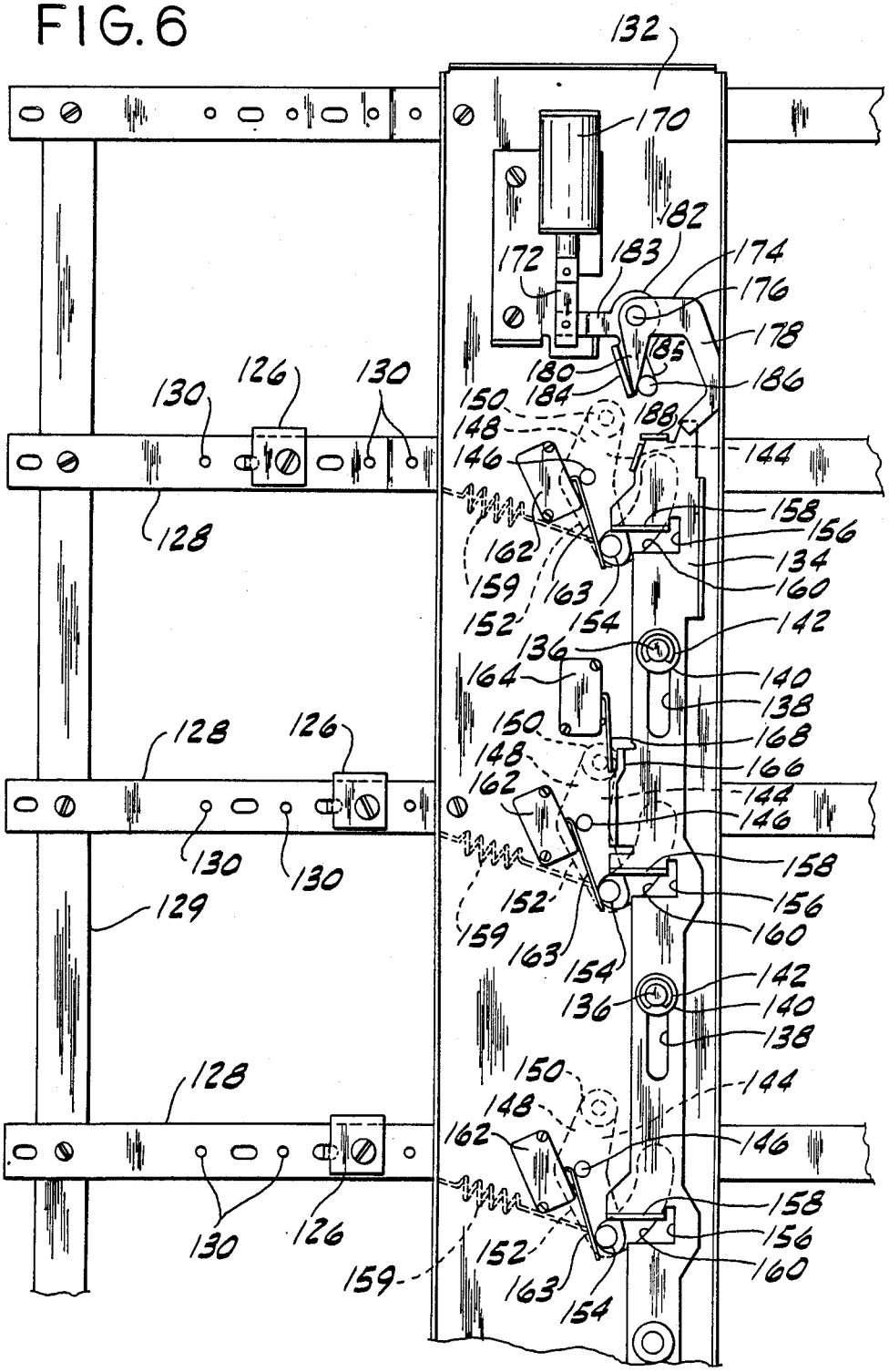
FIG. 6 is a partial rear view of the locking mechanism for the product access doors of the preferred embodiment with all of the access doors in the locked position.

Since the compartments on the drum 30 can be of different widths, provision is made for limiting the width an access door 12 can be opened. This is accomplished by positioning a stop member 126 at an appropriate location along a strip 128 which is fixed to the inside of the service door 14. The strips 128 are each bolted to the respective horizontal bar 124 and to a vertical support strip 129 which is itself bolted to the service door 14 (FIG. 6). Appropriate threaded holes 130 are positioned along the strip 128 to place the stop member 126 at locations which correspond to the distance the door 12 should be opened to limit access to a compartment depending on the positioning of a partition 90 on the tray 42. An access door 12 is actually stopped in its opening movement by having its rear edge come into engagment with the edge of the stop member 126 as the door is slid from its closed position in the channels 120 and 122. Since setting the location of the stop member 126 determines the distance a particular access door 12 can be opened, it is necessary to set all partitions 90 for the same width of compartment on a given shelf 40 since they must all be accessed by the same door 12.

The locking mechanism which normally prevents any of the access doors 12 from being opened is shown in FIGS. 6–10. A locking mechanism support plate 132 is bolted to the side of the strips 128. A single vertical locking strip 134 is mounted for sliding vertical movement to the support plate 132 by pins 136 which are received in slots 138 formed in the locking strip 134. The locking strip 134 is held on the pins 136 by washers 140 and lock rings 142.

Adjacent each access door 12 is positioned a bellcrank 144 mounted with a pin 146 at its pivot point to the support plate 132. Each of the upper arms 148 of the bellcranks 144 has a roller 150 mounted thereto which is in a position to be engaged by the rear edge of an associated access door 12 as it is slid open. The lower arm 152 of each bellcrank 144 also has a pin 154 attached thereto which is received in a horizontal slot 156 formed in the locking strip 134. Each slot 156 is formed with an upper lip 158 which forms a camming surface for engaging the pin 154. A clearance slot 160 is formed in the support plate 132 for each pin 154 to allow pivotal movement of each bellcrank 144 and engagement between each pin 154 and its respective camming surface 158. Each bellcrank 144 is biased by a spring 159 towards its rest position which corresponds to the closed position of an associated access door 12.

Mounted to the support plate 132 adjacent each bellcrank 144 is a microswitch 162. The activation arm 163 of each switch 162 engages the respective pin 154 when in the rest position shown in FIG. 6. This position corresponds to the closed position of the respective access door 12. In this position the switch 162 is turned off. A further microswitch 164 is located near the top of the locking strip 134 as shown in FIG. 6. A camming surface 166 is formed on the locking strip 134 and is engaged by the activation arm 168 of the microswitch 164. When the locking strip 134 is in the rest position the activation arm 168 is resting above the camming surface 166 as shown in FIG. 6.

Mounted on the upper portion of the support plate 132 is a solenoid 170. Its plunger 172 is normally in the extended position as shown in FIG. 6 when the access doors 12 are closed, and when activated is in the retracted position shown in FIG. 8 to allow an access door 12 to be opened. Another bellcrank 174 is pivotally mounted to the support plate 132 by pin 176 and has a hook-shaped arm 178 and a tapered arm 180. A further bellcrank 182 is pivotally mounted to the same pin 176 and has a first arm 183 pined for pivotal movement to the plunger 172 and a second arm 185 which has a guide surface 184 formed therein and a roller 186 mounted thereon. The tapered arm 180 of bellcrank 174 is captive between the roller 186 and guide surface 184 so that when the plunger of the solenoid 170 is actuated both bellcranks 174 and 182 pivot about pin 176.

Figure 8:
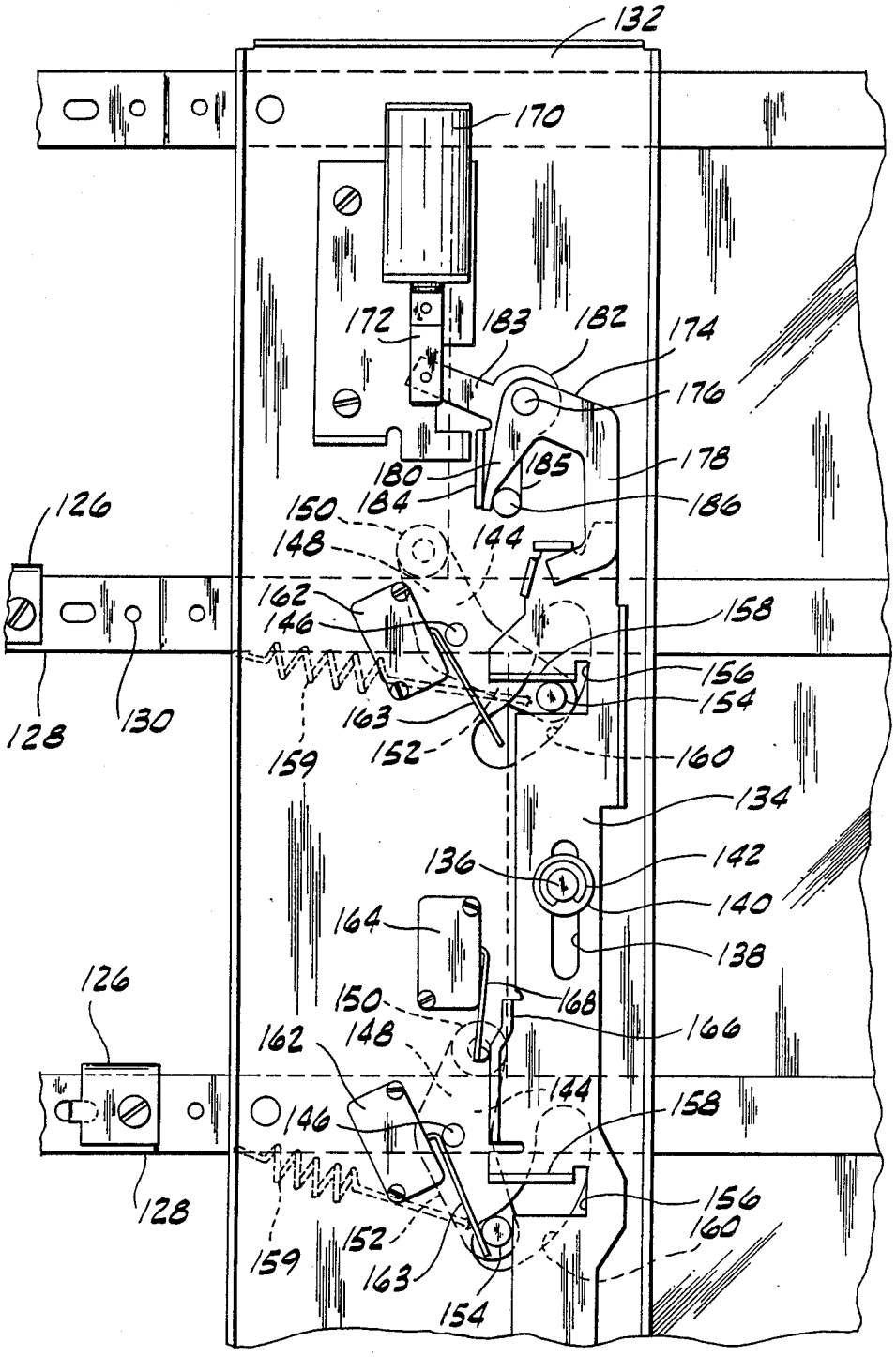
FIG. 8 is a view similar to FIG. 6 showing the top access door partially open and the next lower door closed.
Figure 9:
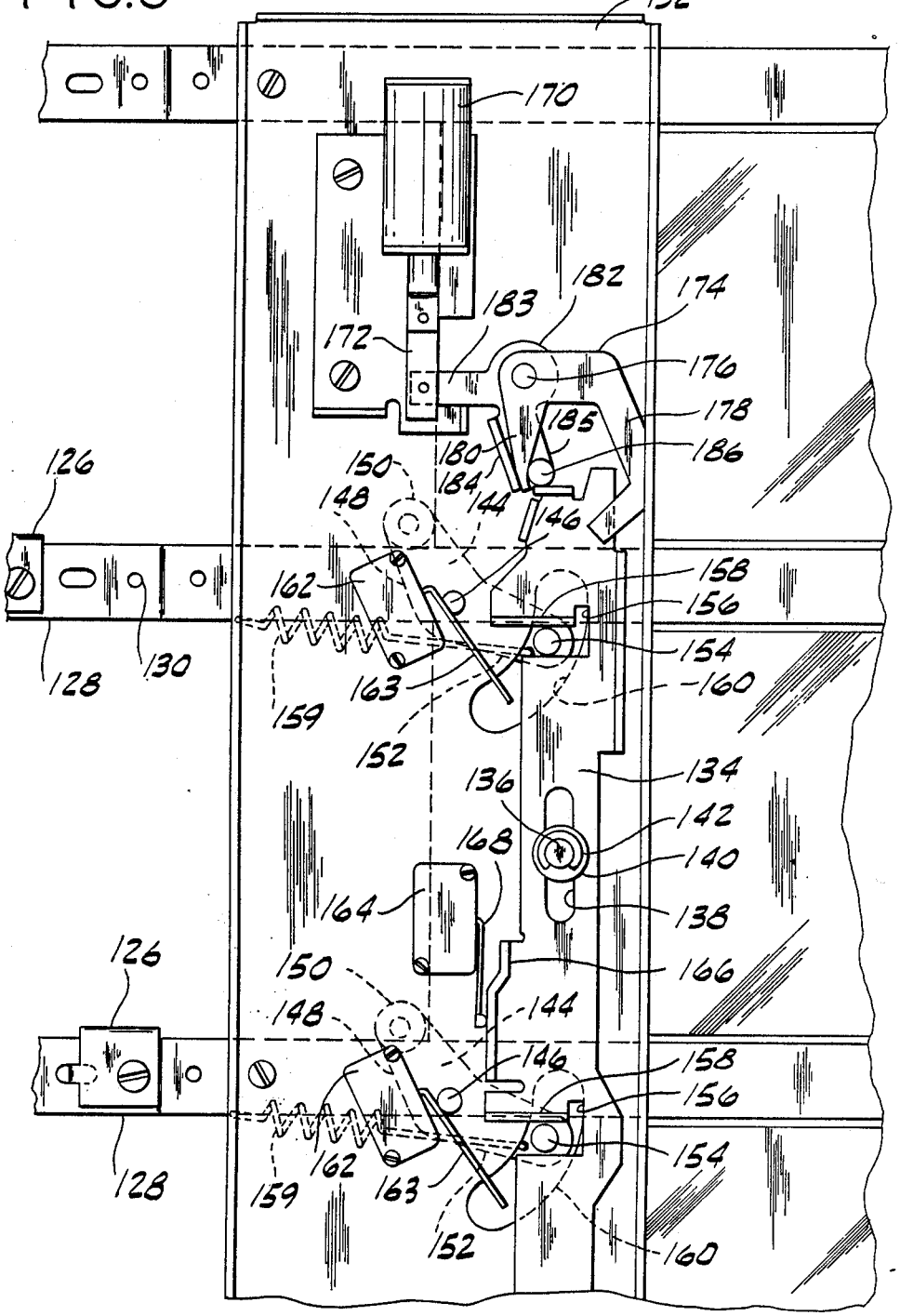
FIG. 9 is a view similar to FIG. 6, but with both doors partially open.

In operation, the roller 150 on upper arm 148 of a bellcrank 144 is engaged by the rear edge of an associated access door 12 as it is moved from the closed position, as shown in FIG. 6, toward the open position as shown in FIG. 9. This causes rotation of the bellcrank 144 which in turn causes the pin 154 on the lower arm 152 to move into the slot 156. Engagement of pin 154 with the camming surface 158 causes upward movement of the locking strip 134. Once one of the doors 12 has been moved slightly the upward movement of the locking strip 134 caused thereby prevents a second door 12 from being moved since its associated pin 154 would strike the side of the locking strip below the slot 156 as seen in FIG. 8.

The access door locking system is controlled by a microprocessor so that information from the microswitches 162 and 164 can be utilized to determine if the solenoid 170 should be activated to allow an access door 12 to be opened. First, the microprocessor determines if the switch 164 has been activated by upward movement of the locking strip 134 due to the movement of the actuating arm 168 on the camming surface 166. If switch 164 is not on, the microprocessor does not activate the solenoid 170 even if one of the switches 162 indicates movement of one of the doors. Switch 164 does not activate until locking bar 134 is raised to a height to prevent opening a second door as shown in FIG. 8. This is a security test to deter tampering with the machine.

If switch 164 is sensed to be on then the microprocessor checks if any of the switches 162 are on. If more than one switch 162 is on this indicates there is an attempt being made to open more than one access door, as shown in FIG. 9, and the solenoid 170 is prevented from being actuated. If only one switch 162 is sensed to be on then the solenoid 170 is activated, assuming other conditions being monitored by the microprocessor are acceptable, such as adequate credit being established to match the cost of the item in the compartment behind the access door 12 which is being opened.

Figure 10:
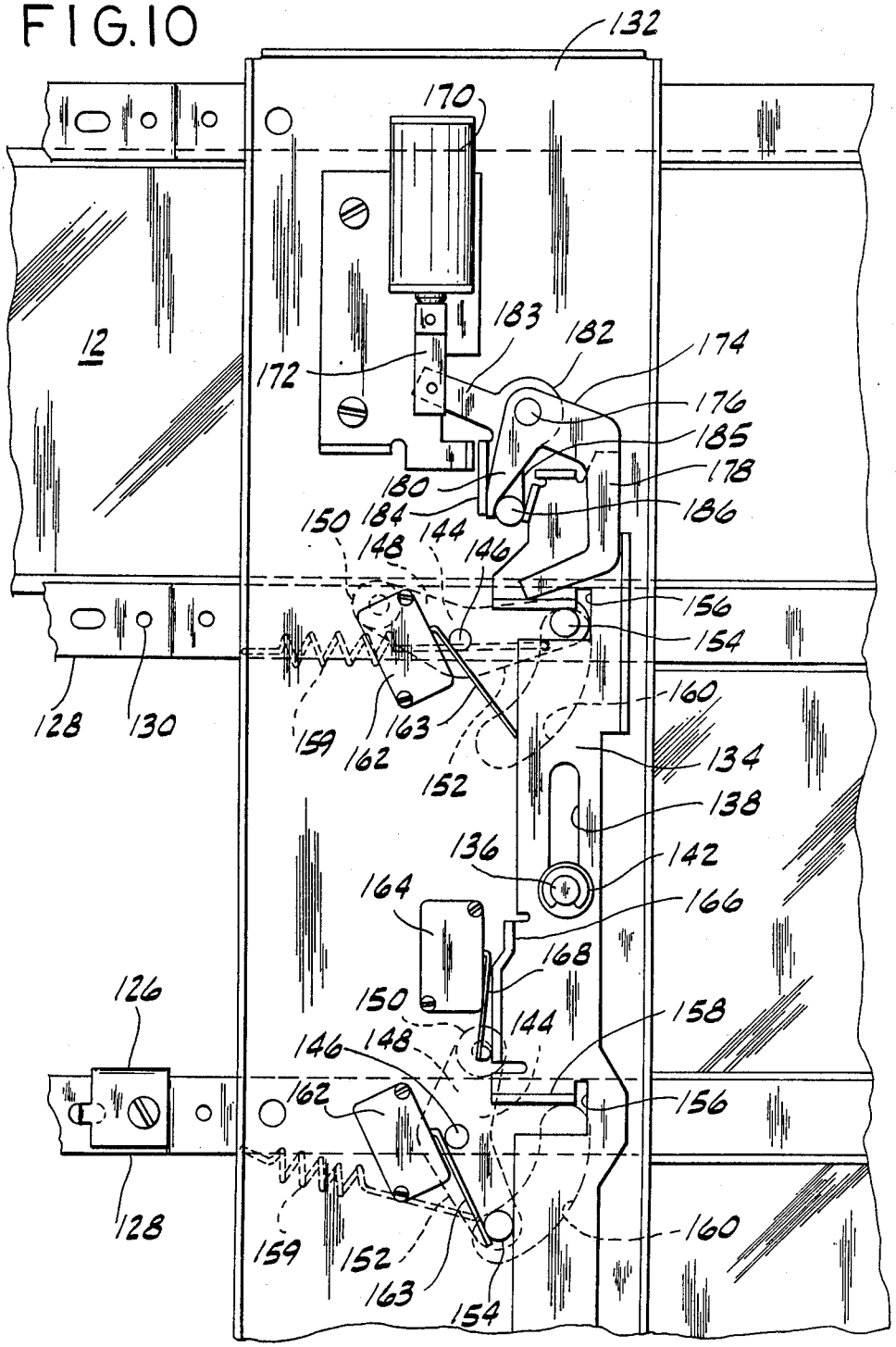
FIG. 10 is a view similar to FIG. 8 with the top access door completely open.

Assuming all other such conditions are favorable, the solenoid 170 is activated to pull plunger 172 upward. This in turn causes pivoting of bellcranks 174 and 182 so that hook-shaped arm 178 falls in behind the upward movement of the lip 188 on the upper end of the locking strip and roller 186 is moved to a position so that the locking strip can extend its upward movement to its fullest as the roller 150 rolls from the rear vertical edge of its associated access door 12 to the bottom horizontal edge thereof as the door slides by, as shown in FIG. 10. The actuated solenoid 170 holds the locking strip 134 up so that pin 154 can't enter any of the corresponding slots 156 and thus prevents a customer from switching access doors quickly after a selection has been made. The hook-shaped end of arm 178 facilitates the return of the solenoid to its rest position if the plunger 172 were to become stuck in the solenoid.

If the microprocessor determines that the solenoid 170 should not be activated to allow any of the access doors 12 to be opened, the upper surface of the lip 188 on the locking strip 134 will engage the bottom of roller 186 as an attemot is made to open a door and will prevent the strip from moving far enough up to allow a roller 150 to pass from the vertical rear edge of an access door to the bottom horizontal edge thereof and thus prevent the door from being opened, as shown in FIG. 9.

Figure 11:
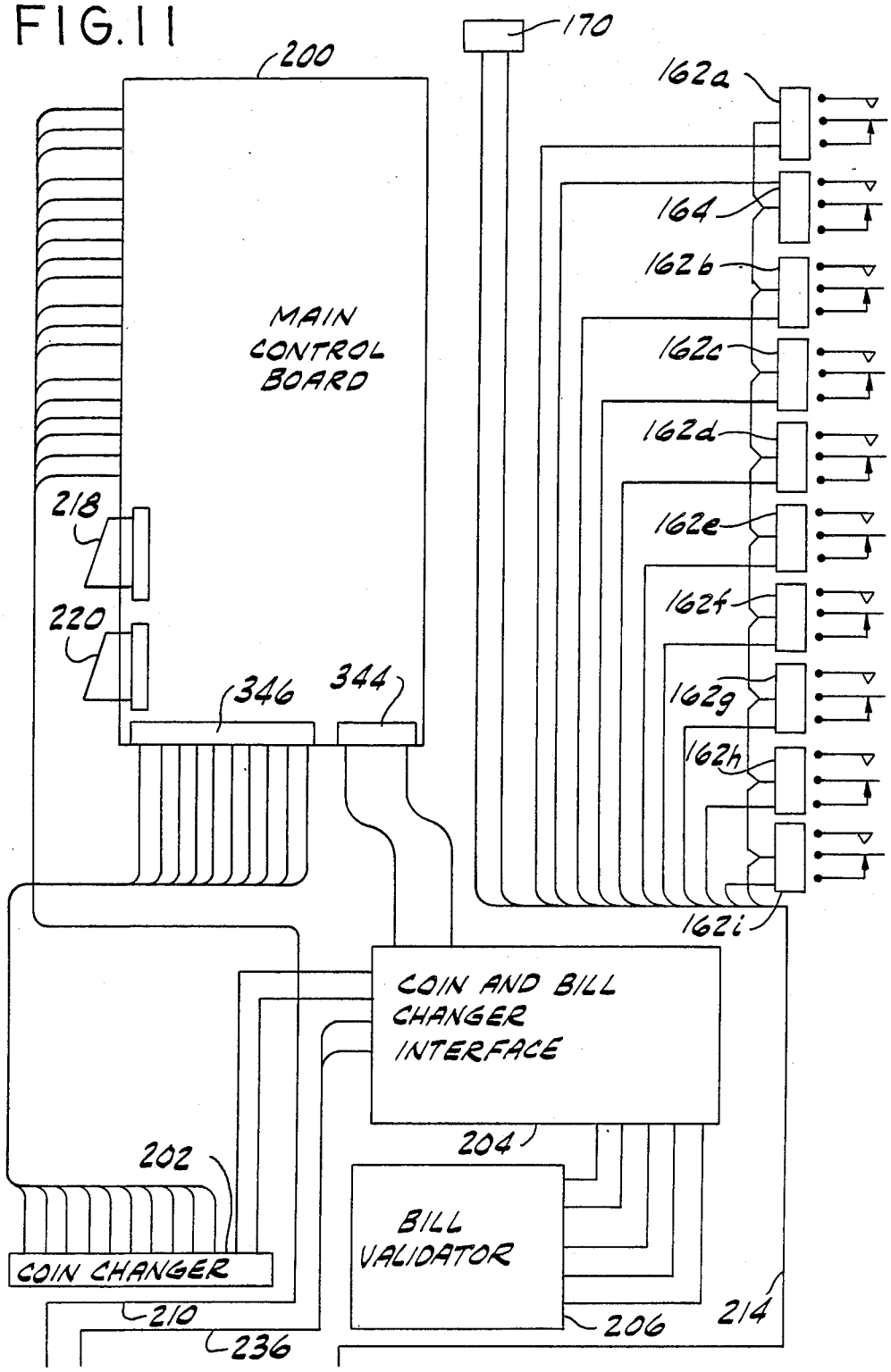
FIGS. 11–13 are schematics of portions of the circuitry of the present invention showing the wiring and component locations and interconnections.
Figure 12:
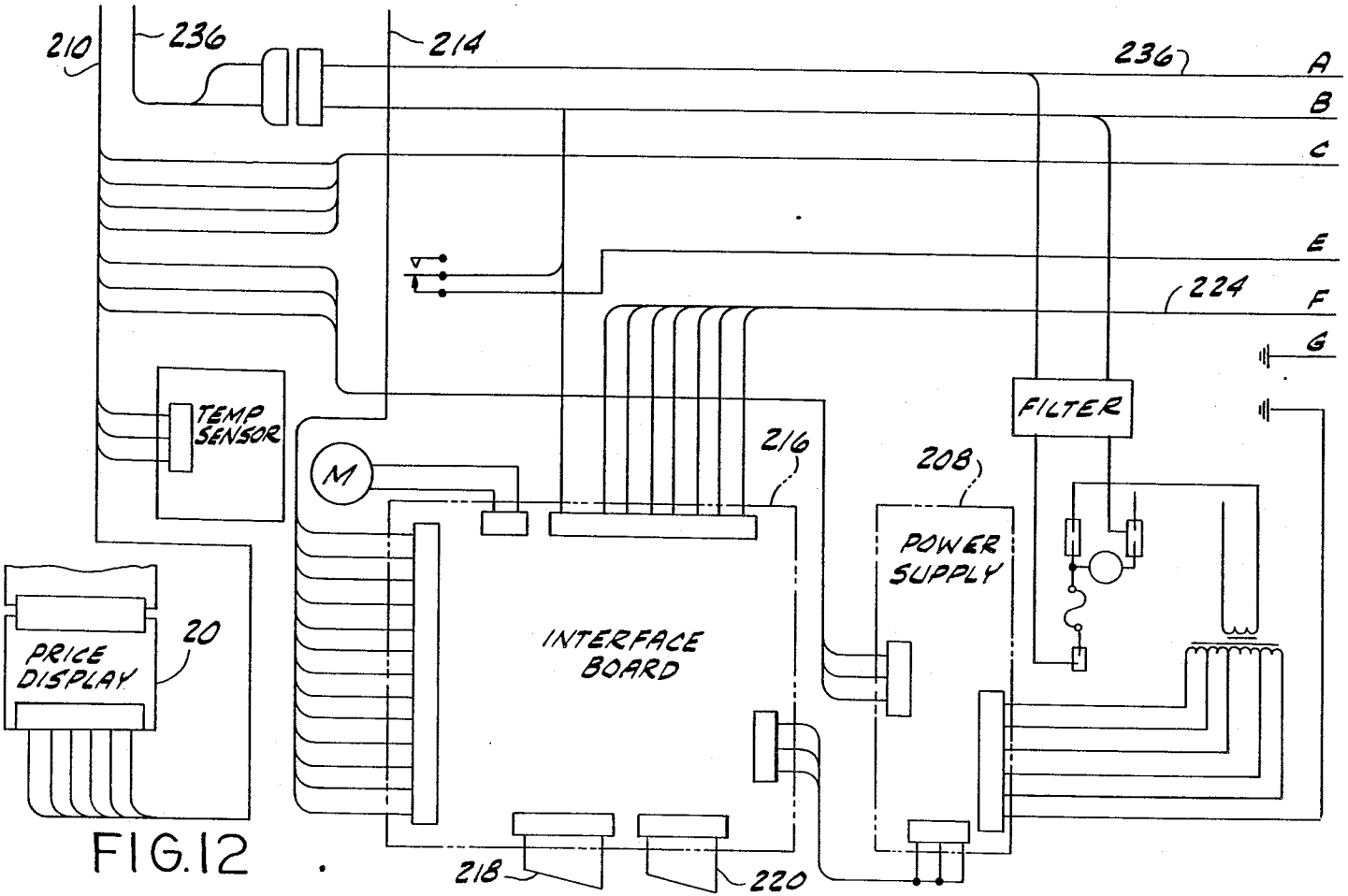
Figure 13:
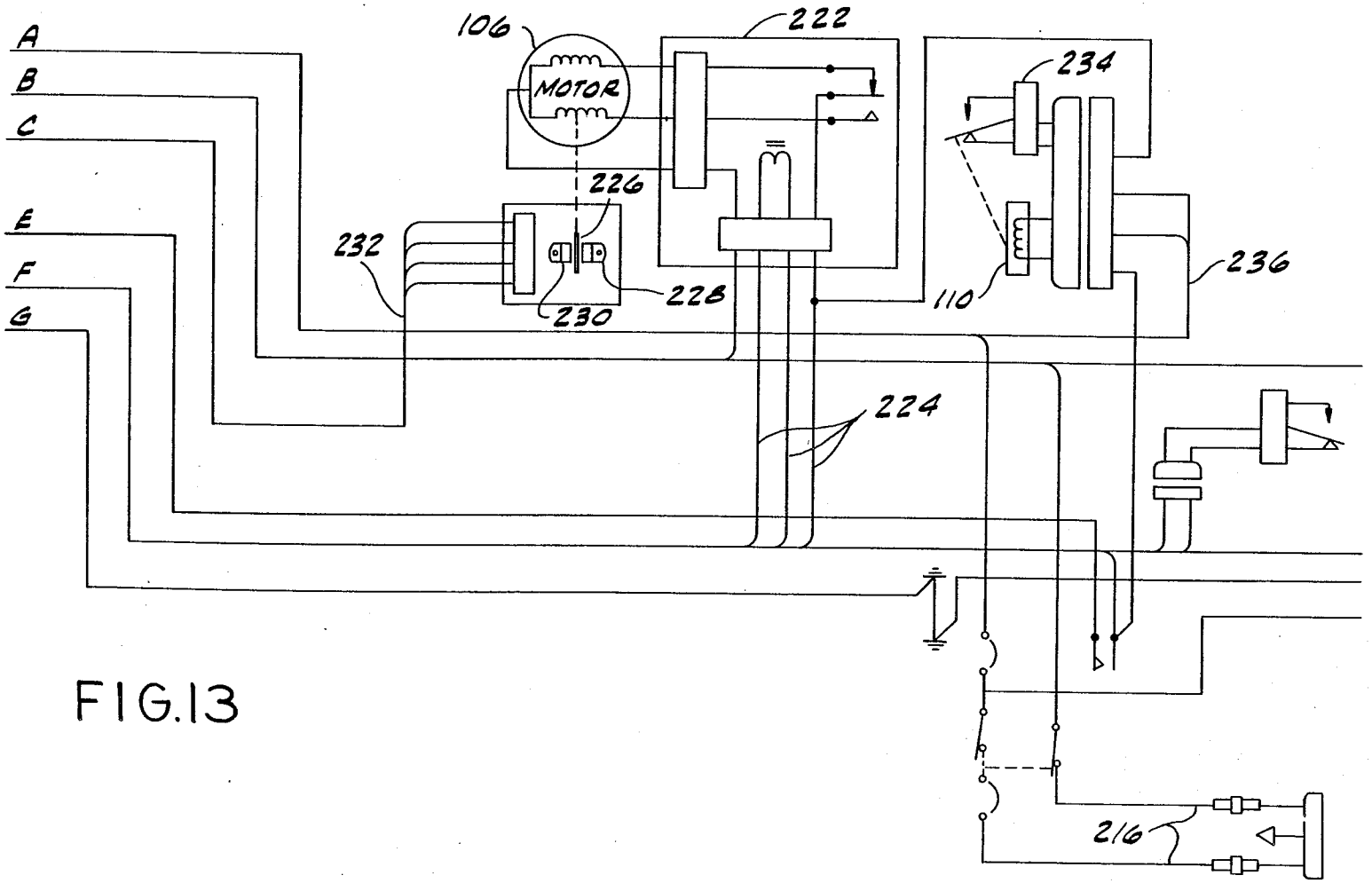
Figure 14:
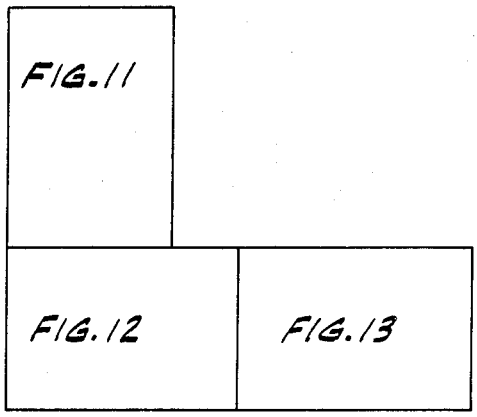
FIG. 14 is a diagramatic showing of the proper positioning of FIGS. 11–13 to show the wiring diagram as a whole.

Referring now to the control circuitry for the present invention, as shown in FIGS. 11–13 (the proper arrangement of which in order to view the circuit as a whole is shown in FIG. 14), the main control board 200 which includes the microprocessor, peripherial interfaces and other control circuitry, described in detail below, is connected to the coin changer 202 and the coin and bill changer value interface 204. The bill validator 206 and coin changer 202 are connected to the coin and bill value interface 204. This connection allows the microprocessor to receive information with respect to the amount of money deposited by a customer in the machine and to signal the coin changer to supply change to the customer if appropriate.

The main control board 200 is further connected to a power supply 208 (FIG. 12) via lines 210 to supply the steady state voltages necessary to operate the microprocessor and other components on the main control board. Each of the microswitches 162*a–i* (FIG. 11), which are associated with a respective access door 12 as discussed in detail above, as well as microswitch 164 and solenoid 170 are connected via lines 214 through the interface board 216 and further multiple lines 218 and 220 to the microprocessor on main control board 200.

The reversible drive motor 106 for the merchandise carrying drum 30 (FIG. 13) is connected to a direction control circuit 222 which changes the direction of rotation of the motor 106 on command from the microprocessor on the main control board 200 via lines 224. The position and direction of rotation of the motor 106 is kept track of by a timing disk 226, two light sources 228 and two corresponding photo sensors 230. The timing disk is connected either directly or through gears, etc. to the output shaft of motor 106 for rotation therewith. The disk has a plurality of equally spaced holes around its periphery in registry with the light source and photo sensor so that light passes through these holes as the disk rotates and is sensed by the photo sensors which transmit signals, one for direction and one for distance, to the microprocessor on the main control board 200 via lines 232.

As previously mentioned, the plunger 112 is inserted in one of the series of holes 114 as the drum 30 is stopped in its rotation. In order to effect this motion, a switch 234 (FIG. 13) associated with the solenoid 110 is used to activate or deactivate the motor solenoid on command from the microprocessor via lines 236. To achieve this properly, the circuit is arranged so that the switch prevents the motor from being activated until plunger 112 is withdrawn from one of the holes 114 and is kept running after it is started until the plunger is inserted in a hole.

Figure 22:
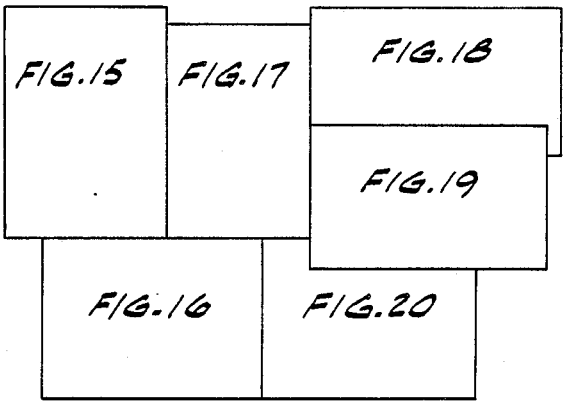
FIG. 22 is a diagramatic showing of the proper positioning of FIGS. 15–21 to show the circuitry as a whole.
Figure 15:
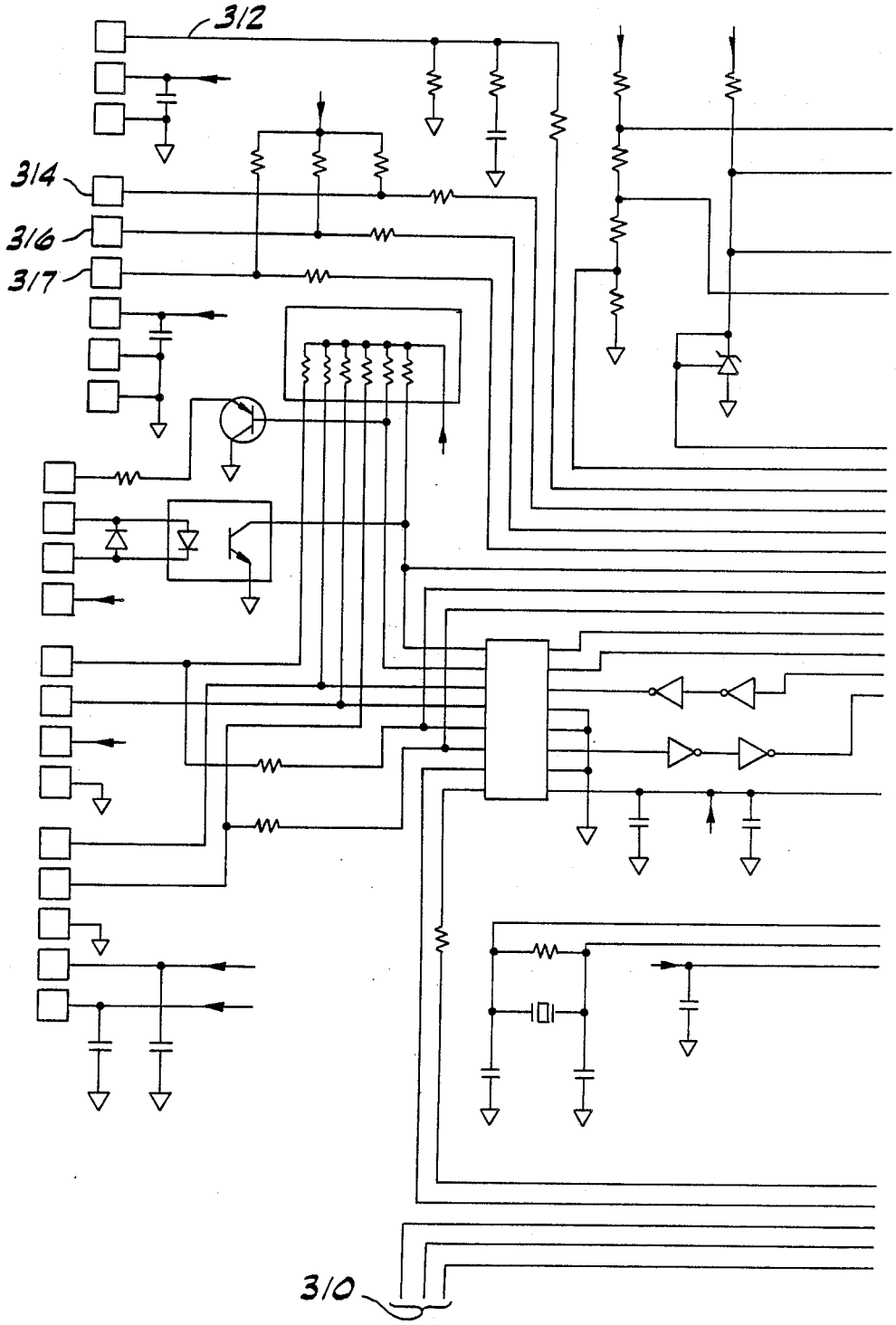
FIG. 15–21 are schematics showing the interconnections of the microprocessor control circuitry and their connection to the various operating components.
Figure 16:
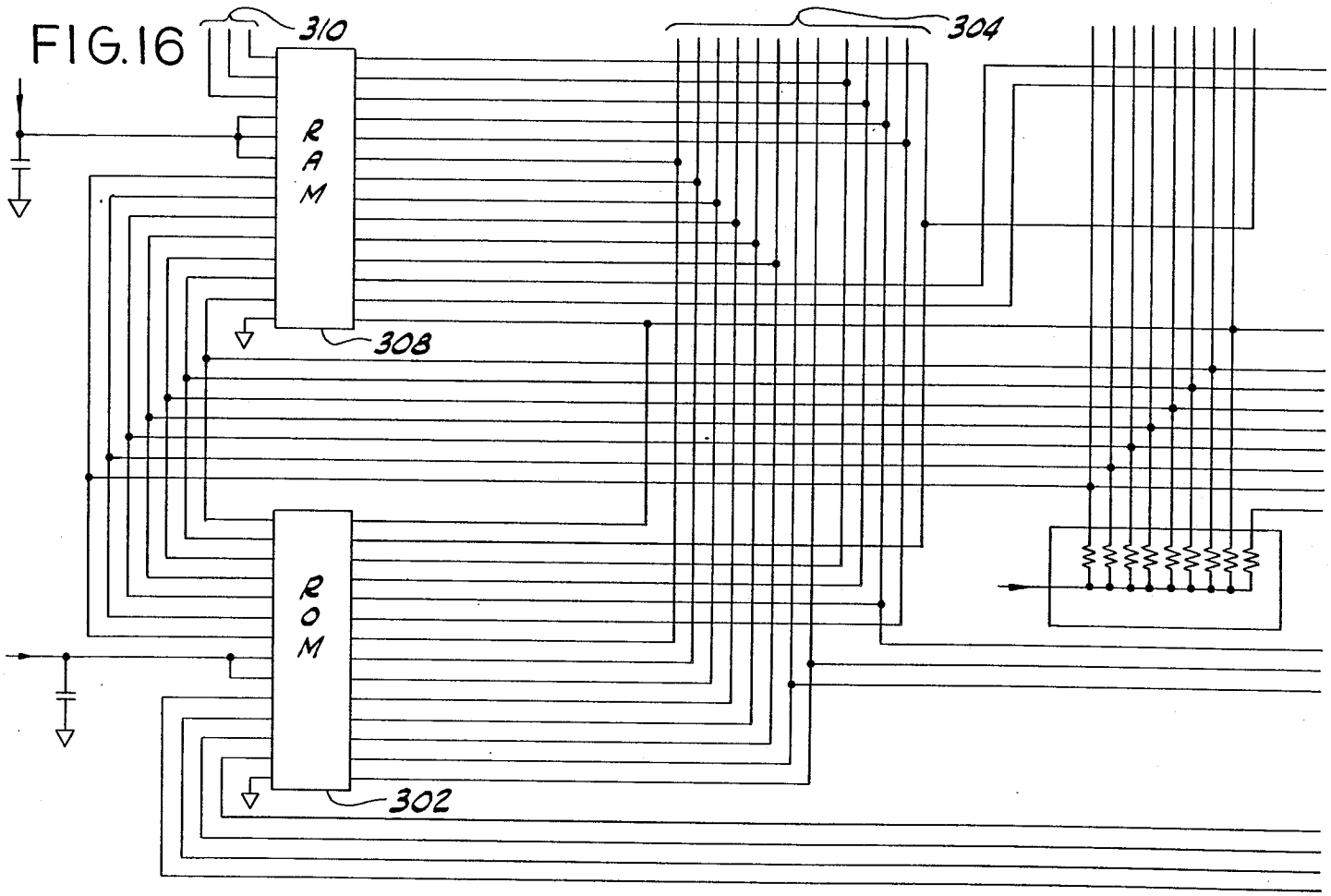
Figure 17:
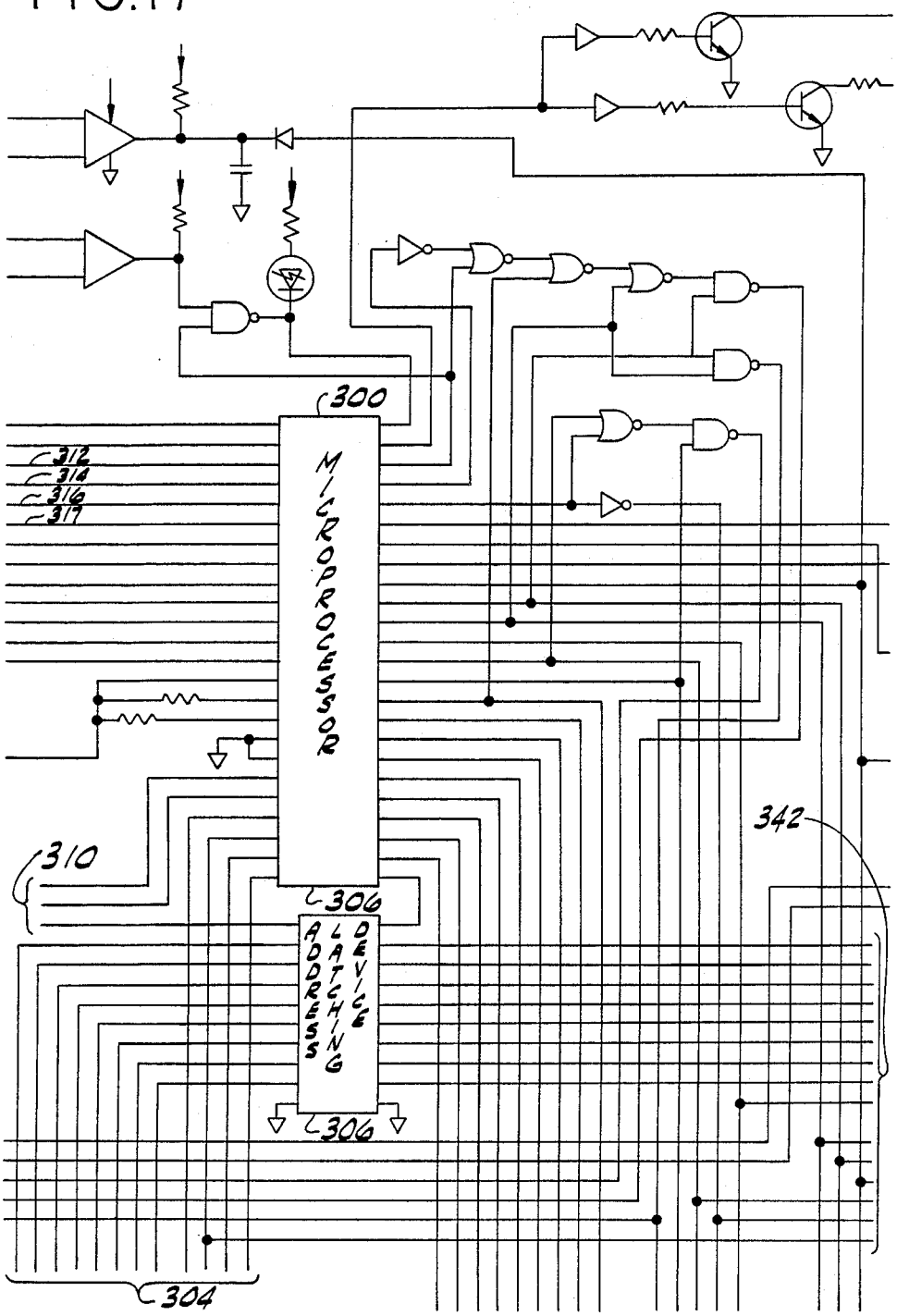

A more detailed illustration of portions of the circuit of FIGS. 11–13 is shown in FIGS. 15–21, the proper arrangement of which to see the circuit as a whole is shown in FIG. 22. In this circuit the connection of the microprocessor on the main control board to various functional components of the invention is illustrated. The microprocessor 300 (FIG. 17), such as an M68HC11A1 microprocessor, manufactured by Motorola, which forms the main CPU is conventional, as are all of the other components used in the circuitry, and is used to process the information used to operate the machine and operates under the control of a program stored in ROM 302 (FIG. 16). ROM 302, which can be, for example, a 27256 ROM, as manufactured by Intel, is connected via lines 304 and address latching device 306, such as a 74HC573, as manufactured by Motorola, to the microprocessor 300. RAM 308 (FIG. 16), which can be, for example, a DS1240, manufactured by Dallas Semiconductor, is used for data storage such as prices, number of vends from a particular compartment, money accumulation in cash box, etc. RAM 308 is connected to microprocessor 300 via lines 310 and 304 to supply data to and receive information from the microprocessor. Data from a temperature probe (not shown) positioned within the cabinet adjacent the merchandise carrying drum 30 to keep track of the temperature over time is received by the microprocessor 300 through data line 312 (FIG. 15).

A door switch (not shown) is mounted within the service door 14 behind the monetary door 27 in engagement therewith so that when the door 27 is opened a signal is sent to the microprocessor 300 via line 314. This signal is used by the main program to enable the control panel 29 when the monetary door 27 is open and to disable it when the door 27 is closed. This prevents unauthorized resetting of the prices, etc. by inserting a wire or the like through a small opening in the machine to tamper with the control panel when the door 27 is closed and the machine is in operation.

Connected through lines 316 and 317 to the microprocessor 300 are the photo sensors 230 associated with the motor position sensing system described above. The microprocessor can then determine the position of the drum 30 based on the input from the sensors 230 and the home position switch 111 of the drum 30.

Figure 18:
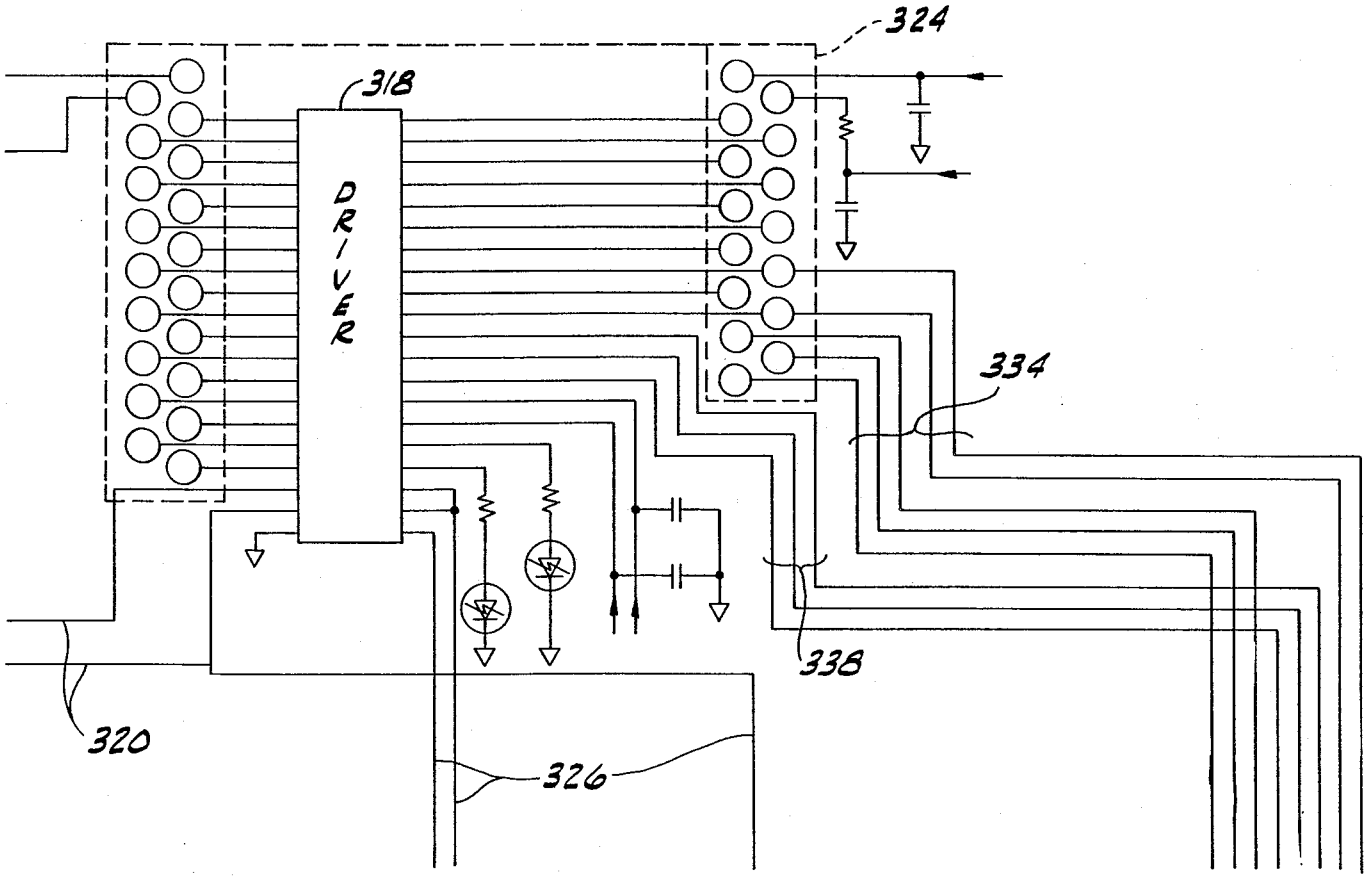
Figure 19:
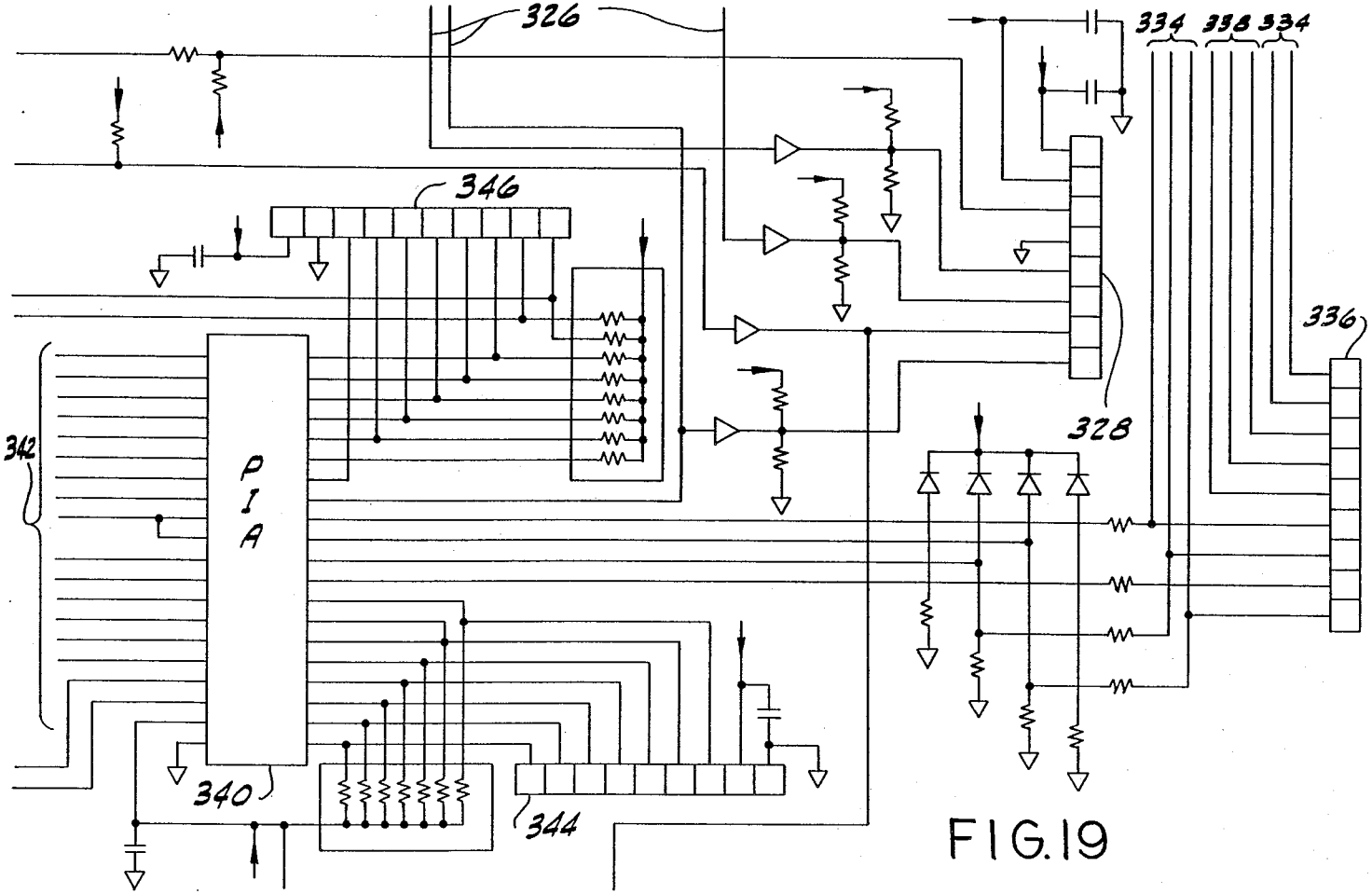
Figure 21:
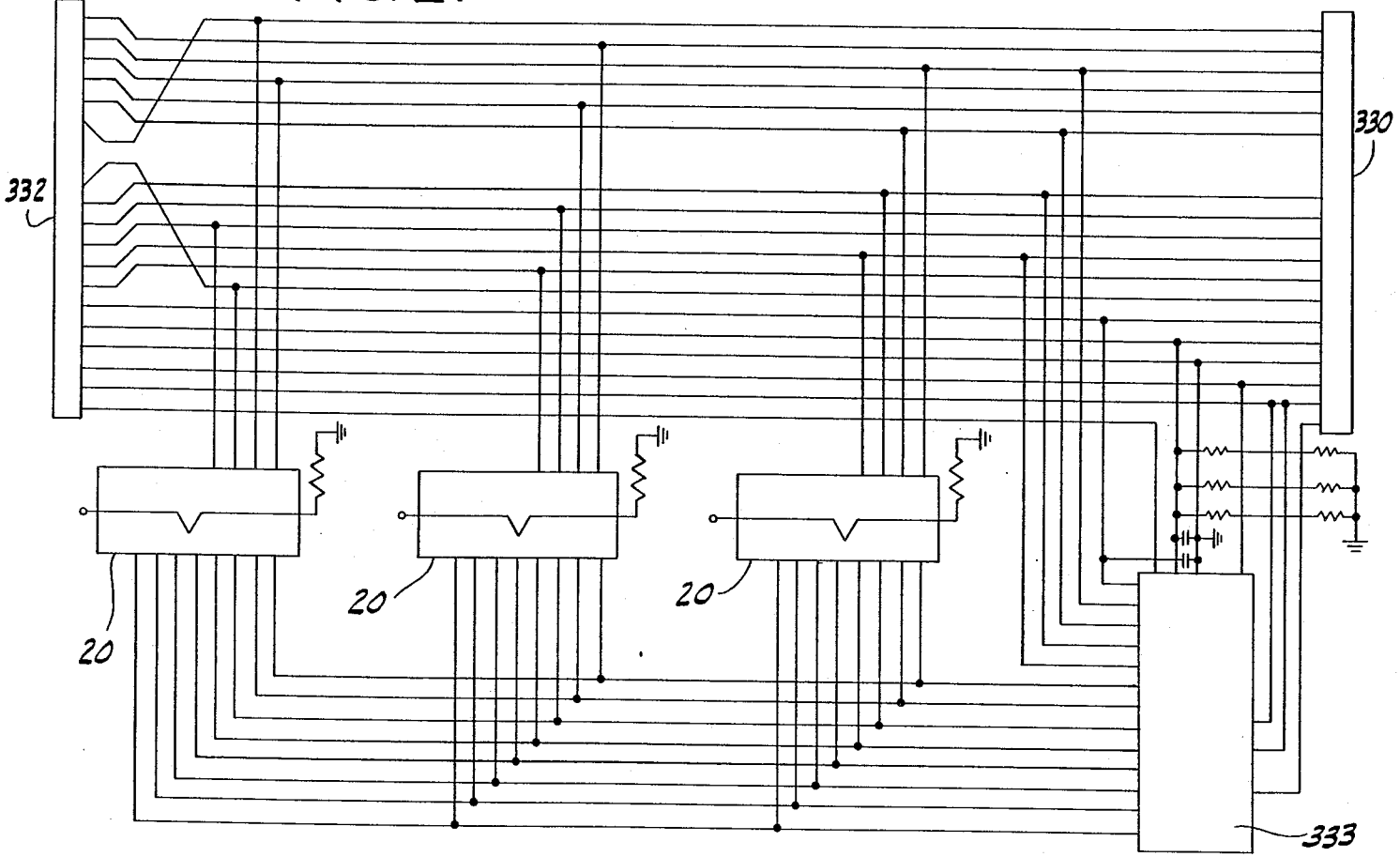

In FIG. 18 is shown a driver 318, such as an SN75518, as manufactured by Texas Instruments, connected by lines 320 to the microprocessor 300 and through the connector 324 to the credit display 21 and switches 107 and 109. Through this connection the microprocessor 300 can provide the credit information to the display upon receipt of signals from the coin and bill changing and validating mechanisms 22 and 24 as to what coins and/or bills have been deposited. Lines 326 coming from the driver 318 are attached to the connector 328 which is in turn attached through the connector 332 to the price displays 20 through driver 333, as shown in FIGS. 12 and 21. In the preferred embodiment there are nine price displays 20 each associated with a respective access door 12. In the illustration of FIG. 21 the details of the connection between the displays 20 are shown.

In FIG. 21 only three of the nine price displays 20 of the preferred embodiment are shown. These displays are connected in series to the rest of the displays 20 through the connector 332. In other words, there are three sets of the circuit shown in FIG. 21 which are connected in series to form the nine displays of the preferred embodiment. The circuitry is arranged so that one group of signals from the microprocessor 300 are used to control only portions of each bank of three displays and another group of signals from the microprocessor are used to control another portion of each group of three displays. From a data processing point of view, this procedure is more efficient than sending a complete group of signals to control each group of three displays.

In FIG. 18, lines 334 coming from the connector 324 are connected through the connector 336 (FIG. 19) to the control panel 29 and to a peripheral interface adapter (PIA) 340. Lines 338 (FIG. 18) are also connected through connector 336 to the control panel 29. Thus, the control panel 29 is connected through the driver 318 to the microprocessor 300 to control various functions of the control program as discussed in more detail below.

Referring again to FIG. 19, PIA 340 is connected to the microprocessor 300 via lines 342 and is connected through connector 344 to the interface board 204 (FIG. 11) where it is, in turn, connected to the coin changer 202 and bill validator 206 to receive information from and send signals to these devices for control purposes.

PIA 340 is also directly connected to the coin changer 202 through connector 346. The PIA 340 is also connected to the price displays 20 through driver 333 via the connector 328 which is connected to connector 330. The prices are set for a given shelf by inserting them into the control panel 29 and viewing them on the credit display 21 as they are inserted. Once the correct price is viewed on the credit display, the operator can store the new prices by manipulating the appropriate door 12 which will cause the price to be stored in memory and to be displayed in the appropriate price display 20 adjacent the proper shelf.

Figure 20:
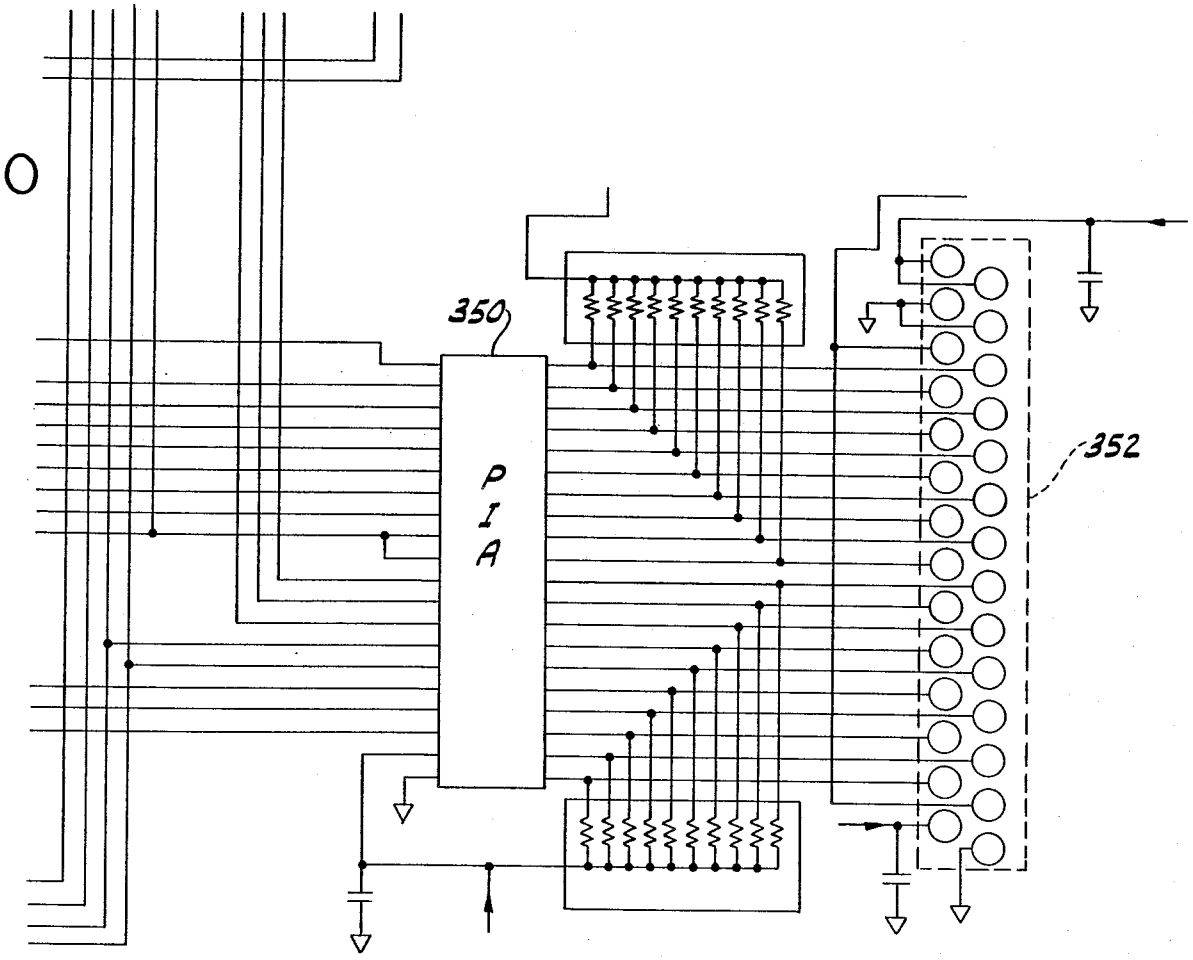

As shown in FIG. 20, a further PIA 350 is connected through a connector 352 to the interface board via connectors 218 and 220 where it is then connected to switches 162*a–i*, switch 164, the compressor relay (not shown), home switch 111, door interlock switch (not shown), motor direction control circuit, solenoid 110 and switch 234.

In the present invention, since the location of the drum and all of the compartments on a drum are kept track of in the control programming, the drum can easily be subdivided into circumferential sections for control purposes. For simplicity, in the preferred embodiment these sections correspond to the 120 degree sections separated by the vertical walls 70. Thus, there are three sections which can be individually treated for various functions and operations as discussed below.

The control program establishes three pricing zones of 120 degrees each for each shelf 40. The actual location of each of these zones is kept track of through use of the drum homing location and motor rotation position monitored by the microprocessor 300. In order to set prices for these zones the drum is rotated so that the desired zone on a shelf is positioned adjacent the access door for that shelf and the access door is then moved to activate its associated switch 162. This is monitored by the microprocessor and the subsequent price set for that zone on the control panel is then stored in memory and associated with that zone for future use. As previously mentioned, when the prices are being set they first appear on the credit display 21 as they are entered on the control panel and then stored and registered on the appropriate display 20 through manipulation of the door.

Since there are three price zones on each of nine shelves in the preferred embodiment, this procedure must be repeated twenty-seven times if all of the prices are to be set, or a particular zone can be reset. For convenience, an indication of the zone which is before the access door whose switch 162 has been activated is shown on the credit display adjacent the position where the price will appear as it is being set. This can be easily done by coding the location of each compartment on the drum.

Although each tray 42 can be subdivided into as many as four compartments, the pricing of each of these compartments within a price zone is preferrably the same since it becomes a large task to change all of the prices in such subdivisions. However, it is to be understood that through relatively simple programming changes and use of the existing equipment of the preferred embodiment prices for each such compartment could be established, if desired.

Since the location of each compartment, including those formed by subdivisions of a tray, are easily kept track of in the present invention as mentioned above, there are many advantages which are obtainable as a result, in addition to the zoned pricing just discussed. For example, in the present invention through the control program the opening of each access door is kept track of by monitoring the switches 162 and 164, and this is coordinated with the location of all of the compartments accessable through that access door so that only one access to a compartment is permitted between the times the machine is serviced. This prevents someone from accessing a compartment, tampering with the item in the compartment, such as food, and then returning the item to the compartment to later be purchased by someone else.

Since in some installation locations for this machine the capacity for items may be greater than the needs of customers who would access that machine between times of servicing, the machine is programmed to prevent one or two of the sections from being brought to the access doors and thus these sections do not have to be loaded with product. For example, one of the sections can be left empty and always rotated to the rear of the machine where it cannot be seen when the machine is at rest, since the machine is programmed to always return to a position where less than half of the trays can be seen by a potential customer. This is accomplished by rotating the drum so that the opaque walls 70 with an included angle of 120 degrees are positioned to the front so that in combination with the side walls of the machine they prevent the potential customer from seeing the remaining two sections. To do this the drum is prevented by the control program from rotating in either direction far enough to where a wall of the restricted section would pass an access door. The drum is automatically reversed in direction once such boundary is reached when the potential customer is operating the direction rotation buttons 107 and 109 (FIG. 1). This restriction can apply to either one or two sections.

Provision is also made in the programming to allow a different section to be brought to the viewing and access area at a different time of day. Thus, the above described restrictions to areas can be moved from one section to another at different times of day. For example, a first section may be accessable from 8:00 a.m. to 4:00 p.m., a second section from 4:00 p.m. to 12:00 a.m. and the third from 12:00 a.m. to 8:00 a.m. This feature is particularly useful in factories with multiple production shifts and can also be used to present different types of products at different times of day such as breakfast, lunch and dinner.

A further use of the feature of monitoring all compartments by the present invention is that the purchase of items from the compartments is kept track of for the entire drum. Thus, the previously described feature of restricting the view to less than half of the drum can be combined with this feature to switch the view from one section to another when the first section becomes unacceptably low in selections of items due to their purchase. For example, in the preferred embodiment, the machine switches the view to the fullest section if this feature is selected by the servicing operator.

A further feature contained in the present invention is the provision of a time of day discount in which the price can be reduced by a certain percentage at a certain time of day as established by the operator through input from the control panel 29. The operator inputs a time at which the discount is to take effect and the percentage of the full price that is to be taken from the full price of the item. At the time for reducing the price the microprocessor to calculate the discounted price and then uses that price as the subsequent price at which the item is to be sold. As with the original price, this feature applies to each shelf and each section of that shelf.

Since the rotational location of the drum is constantly monitored, the shortest distance to return the drum to its desired rest position can be determined and the drum can then be rotated by the reversible motor in that direction to bring the drum to the rest position as soon as possible so it is in the desired viewing position for the next potential customer.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

We claim:

1. A multiple-product merchandising machine comprising:

a cabinet having a viewing area in which the products in several of the compartments on each shelf can be seen at one time by a potential customer;

a cylindrical merchandise carrying drum mounted within the cabinet for rotation about its central longitudinal axis and having a plurality of annular product supporting shelves at spaced intervals along the drum concentric with the axis of the drum, a plurality of walls extending between adjacent shelves and together with the shelves defining a plurality of individual compartments in which product may be placed;

a plurality of access doors in the cabinet, one each associated with a respective shelf on the merchandise carrying drum and disposed adjacent thereto for allowing access to a compartment on the respective shelf when the compartment is aligned with it, the access doors being movable between an open position and a closed position and being normally locked in the closed position;

currency actuated means for allowing a selected access door to be moved from the closed position to the open position when a predetermined amount of currency is inserted by a customer;

reversible motor means for rotating the merchandise carrying drum in either direction;

manually controllable actuating means for actuating the reversible motor means to rotate the merchandising drum to allow a customer to bring any compartment on a shelf into alignment with the associated access door; and control means for activating the motor means at a predetermined time after a selection has been made and in either direction of rotation of the drum to bring the drum to a predetermined rest position at which it is stopped, the control means being operable to determine the number and location of empty compartments and to move the drum to a rest position at which it is stopped and in which the fullest section of the drum with the least number of empty compartments is disposed adjacent the viewing area of the cabinet.

2. A multiple-product merchandising machine as defined in claim 1, wherein at least some of the walls of the merchandise carrying drum are opaque and so disposed around the drum that when the drum is in the rest position at least half of the compartments on the drum cannot be seen through the viewing area by a potential customer.

3. A multiple-product merchandising machine as defined in claim 2, wherein the opaque walls are separated by 120 degrees around the drum and at least some intermediate walls between adjacent opaque walls are transparent.

4. A multiple-product merchandising machine as defined in claim 3, wherein the opaque walls extend the length of the drum and all intermediate walls are transparent and the dimensions and relationship between the drum and the viewing area of the cabinet are such that all of the products in the compartments between adjacent opaque walls which are closest to the viewing area can be seen at one time by a potential customer when the drum is in the rest position but the remainder of the compartments are hidden from view.

5. A multiple-product merchandising machine comprising:

a cabinet;

a cylindrical merchandise carrying drum mounted within the cabinet for rotation about its central longitudinal axis and having a plurality of annular product supporting shelves at spaced intervals along the drum concentric with the axis of the drum, a plurality of walls extending between adjacent shelves and together with the shelves defining a plurality of individual compartments in which product may be placed;

a plurality of access doors in the cabinet, one each associated with a respective shelf on the merchandise carrying drum and disposed adjacent thereto for allowing access to a compartment on the respective shelf when the compartment is aligned with it, the access doors being movable between an open position and a closed position and being normally locked in the closed position;

currency actuated means for allowing a selected access door to be moved from the closed position to the open position when a predetermined amount of currency is inserted by a customer;

reversible motor means for rotating the merchandise carrying drum in either direction;

manually controllable actuating means for actuating the reversible motor means to rotate the merchandising drum to allow a customer to bring any compartment on a shelf into alignment with the associated access door;

a service door in the cabinet being operable to permit access to the interior of the cabinet for loading the compartments in the drum with product, the service door forming a front of the cabinet and the access doors being mounted within the service door;

the drum is mounted for rotation with its axis vertical;

a viewing area in the front of the cabinet formed at least in part by the access doors being transparent and through which the products in several of the compartments on each shelf can be seen at one time by a potential customer; and control means for activating the motor means at a predetermined time after a selection has been made and in either direction of rotation of the drum to bring the drum to a predetermined rest position at which it is stopped, the control means being operable to determine the number and location of empty compartments and to move the drum to a rest position at which it is stopped and in which the fullest section of the drum with the least number of empty compartments is disposed adjacent the viewing area of the cabinet.

6. A multiple-product merchandising machine as defined in claim 5, wherein at least some of the walls of the merchandise carrying drum are opaque and so disposed around the drum that when the drum is in the rest position at least half of the compartments on the drum cannot be seen through the viewing area by a potential customer.

7. A multiple-product merchandising machine as defined in claim 6, wherein the opaque walls are separated by 120 degrees around the drum and at least some intermediate walls between adjacent opaque walls are transparent.

8. A multiple-product merchandising machine as defined in claim 7, wherein the opaque walls extend the length of the drum and all intermediate walls are transparent and the dimensions and relationship between the drum and the viewing area of the cabinet are such that all of the products in the compartments between adjacent opaque walls which are closest to the viewing area can be seen at one time by a potential customer when the drum is in the rest position but the remainder of the compartments are hidden from view.

9. A multiple-product merchandising machine having a cabinet, a cylindrical merchandising drum disposed for rotation about a vertical axis within the cabinet and having a plurality of annular horizontally disposed shelves arranged around the drum at spaced intervals along the axis of the drum and a plurality of walls parallel to the axis of the drum dividing the shelves into separate product carrying compartments, a plurality of normally closed and locked access doors aligned in a common vertical plane on a wall of the cabinet, one each disposed adjacent a respective shelf for allowing a customer to remove product from a compartment aligned with one of the doors, means for accepting currency from a customer, and means allowing opening of one of the doors for dispensing a product from a compartment if the currency accepted is at least equal to the price set for the product in that compartment, said means for allowing opening of the doors including:

a locking strip extending along adjacent edge portions on one side of the doors and supported on the cabinet for limited vertical movement adjacent the doors, lifting means associated with each of the doors for engaging the locking strip when each door is moved from the closed position and for lifting the locking strip to a first position, first sensor means engaging the locking strip to determine if the strip is in the first position, a plurality of second sensor means one each associated with a respective lifting means for sensing if its associated door has been moved from the closed position, locking strip locking means movable between a locking position in which it engages the strip to prevent its movement past the first position thereof, and a further position which allows the lifting means to move the strip to a second position which allows a door to be opened to permit access to a compartment, means associated with the first and second sensor means for determining if the first sensor means has sensed movement of the strip to the first position and for determining if one or more of the doors have been moved from the closed position and for actuating the locking strip locking means to move from the locking position to the further position if the first sensor means is sensed to have been actuated and only if only one of the second sensor means has been actuated.

10. A multiple-product merchandising machine as defined in claim 9 wherein the lifting means are a plurality of bellcrank members one each associated with a respective access door and mounted to the wall of the cabinet for rotation about their central pivot points with a first arm engagable with the edge of the associated access door when it is moved and another arm engagable with the locking strip to move the locking strip when the bellcrank member is pivoted.

11. A multiple-product merchandising machine as defined in claim 10 wherein the locking strip locking means includes a solenoid disposed above the locking strip, a lever means pivotably mounted between the solenoid and the locking strip and secured to the solenoid for pivotal movement when the solenoid is operated and engagable with the strip to prevent upward movement of the strip past the first position unless the solenoid is activated to pivot the lever means.

12. A multiple-product merchandising machine comprising:

a cabinet;

a cylindrical merchandise carrying drum mounted within the cabinet for rotation about its central longitudinal axis and having a plurality of annular product supporting shelves at spaced intervals along the drum concentric with the axis of the drum, a plurality of walls extending between adjacent shelves and together with the shelves defining a plurality of individual compartments in which product may be placed;

a plurality of access doors in the cabinet, one each associated with a respective shelf on the merchandise carrying drum and disposed adjacent thereto for allowing access to a compartment on the respective shelf when the compartment is aligned with it, the access doors being movable between an open position and a closed position and being normally locked in the closed position;

currency actuated means for allowing a selected access door to be moved from the closed position to the open position when a predetermined amount of currency is inserted by a customer;

motor means for rotating the merchandise carrying drum;

manually controllable actuating means for actuating the motor means to rotate the merchandising drum to allow a customer to bring any compartment on a shelf into alignment with the associated access door; and a viewing area in the cabinet in which the products in several of the compartments on each shelf can be seen at one time by a potential customer;

control means for activating the motor means at a predetermined time after a selection has been made so as to bring the drum to a predetermined rest position at which it is stopped, the control means being operable to determine the number and location of empty compartments and to move the drum to a rest position in which the fullest section of the drum with the least number of empty compartments is disposed adjacent the viewing area of the cabinet.

13. A multiple-product merchandising machine as defined in claim 12, wherein at least some of the walls of the merchandise carrying drum are opaque and so disposed around the drum that when the drum is in the rest position at least half of the compartments on the drum cannot be seen through the viewing area by a potential customer.

14. A multiple-product merchandising machine as defined in claim 13, wherein the opaque walls are separated by 120 degrees around the drum and at least some intermediate walls between adjacent opaque walls are transparent.

15. A multiple-product merchandising machine as defined in claim 14, wherein the opaque walls extend the length of the drum and all intermediate walls are transparent and the dimensions and relationship between the drum and the viewing area of the cabinet are such that all of the products in the compartments between adjacent opaque walls which are closest to the viewing area can be seen at one time by a potential customer when the drum is in the rest position but the remainder of the compartments are hidden from view.

16. A multiple-product merchandising machine comprising:

a cabinet;

a cylindrical merchandise carrying drum mounted within the cabinet for rotation about its central longitudinal axis and having a plurality of annular product supporting shelves at spaced intervals along the drum concentric with the axis of the drum, a plurality of walls extending between adjacent shelves and together with the shelves defining a plurality of individual compartments in which product may be placed;

a plurality of access doors in the cabinet, one each associated with a respective shelf on the merchandise carrying drum and disposed adjacent thereto for allowing access to a compartment on the respective shelf when the compartment is aligned with it, the access doors being movable between an open position and a closed position and being normally locked in the closed position;

currency actuated means for allowing a selected access door to be moved from the closed position to the open position when a predetermined amount of currency is inserted by a customer;

motor means for rotating the merchandise carrying drum;

manually controllable actuating means for actuating the motor means to rotate the merchandising drum to allow a customer to bring any compartment on a shelf into alignment with the associated access door; and a service door in the cabinet being operable to permit access to the interior of the cabinet for loading the compartments in the drum with product, the service door forming a front of the cabinet and the access doors being mounted within the service door;

the drum is mounted for rotation with its axis vertical;

a viewing area in the front of the cabinet formed at least in part by the access doors being transparent and through which the products in several of the compartments on each shelf can be seen at one time by a potential customer;

control means for activating the motor means at a predetermined time after a selection has been made so as to bring the drum to a predetermined rest position at which it is stopped, the control means being operable to determine the number and location of empty compartments and to move the drum to a rest position at which it is stopped and in which the fullest section of the drum with the least number of empty compartments is disposed adjacent the viewing area of the cabinet.

17. A multiple-product merchandising machine as defined in claim 16, wherein at least some of the walls of the merchandise carrying drum are opaque and so disposed around the drum that when the drum is in the rest position at least half of the compartments on the drum cannot be seen through the viewing area by a potential customer.

18. A multiple-product merchandising machine as defined in claim 17, wherein the opaque walls are separated by 120 degrees around the drum and at least some intermediate walls between adjacent opaque walls are transparent.

19. A multiple-product merchandising machine as defined in claim 17, wherein the opaque walls extend the length of the drum and all intermediate walls are transparent and the dimensions and relationship between the drum and the viewing area of the cabinet are such that all of the products in the compartments between adjacent opaque walls which are closest to the viewing area can be seen at one time by a potential customer when the drum is in the rest position but the remainder of the compartments are hidden from view.

* * * * *